US009372433B2

(12) United States Patent
Suhara et al.

(10) Patent No.: US 9,372,433 B2
(45) Date of Patent: Jun. 21, 2016

(54) ELECTROSTATIC LATENT IMAGE FORMING METHOD, ELECTROSTATIC LATENT IMAGE FORMING APPARATUS, AND IMAGE FORMING APPARATUS

(71) Applicants: Hiroyuki Suhara, Kanagawa (JP); Hiroaki Tanaka, Kanagawa (JP)

(72) Inventors: Hiroyuki Suhara, Kanagawa (JP); Hiroaki Tanaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/830,352

(22) Filed: Aug. 19, 2015

(65) Prior Publication Data

US 2016/0004181 A1 Jan. 7, 2016

Related U.S. Application Data

(63) Continuation of application No. 14/174,205, filed on Feb. 6, 2014, now Pat. No. 9,146,493.

(30) Foreign Application Priority Data

Mar. 7, 2013 (JP) ..... 2013-044850

(51) Int. Cl.
*G03G 15/043* (2006.01)
*B41J 2/385* (2006.01)
*B41J 2/435* (2006.01)

(52) U.S. Cl.
CPC ..... *G03G 15/043* (2013.01); *B41J 2/385* (2013.01); *B41J 2/435* (2013.01)

(58) Field of Classification Search
CPC ..... B41J 2/385; G03G 15/043
See application file for complete search history.

(56) References Cited

U.S. PATENT DOCUMENTS

| | | | | |
|---|---|---|---|---|
| 4,460,909 | A * | 7/1984 | Bassetti | G06K 15/128 347/129 |
| 5,357,583 | A * | 10/1994 | Sato | H04N 1/4092 382/269 |
| 6,177,948 | B1 * | 1/2001 | Estabrooks | B41J 2/385 347/129 |
| 6,271,868 | B1 * | 8/2001 | Kashihara | G03G 15/011 347/115 |
| 2002/0075372 | A1 * | 6/2002 | Nagumo | G06K 15/128 347/131 |
| 2005/0179971 | A1 | 8/2005 | Amada et al. | |
| 2008/0056746 | A1 | 3/2008 | Suhara | |
| 2008/0170282 | A1 | 7/2008 | Amada et al. | |
| 2009/0034002 | A1 | 2/2009 | Shibaki et al. | |
| 2009/0051982 | A1 | 2/2009 | Suhara | |
| 2009/0220256 | A1 | 9/2009 | Suhara et al. | |

(Continued)

FOREIGN PATENT DOCUMENTS

| | | |
|---|---|---|
| JP | 09-085982 | 3/1997 |
| JP | 2002-205425 | 7/2002 |
| JP | 2004-181868 | 7/2004 |

(Continued)

*Primary Examiner* — Julian Huffman
*Assistant Examiner* — Michael Konczal
(74) *Attorney, Agent, or Firm* — Oblon, McClelland Maier & Neustadt, L.L.P

(57) ABSTRACT

An electrostatic latent image forming method for forming, on an image carrier, an electrostatic latent image that has a pattern where there are an irradiated area and a not-irradiated area in a mixed manner, the electrostatic latent image forming method comprises; adjusting an exposure condition of an irradiated area that is included in the irradiated area and is adjacent to the not-irradiated area so that an electric field intensity of an electrostatic latent image that corresponds to the not-irradiated area is increased so as to prevent adhesion of a developer, and irradiating the image carrier with light under the adjusted exposure condition.

20 Claims, 34 Drawing Sheets

: BLACK DOT THAT IS ADJACENT TO WHITE DOT

(56) References Cited

U.S. PATENT DOCUMENTS

| | | | |
|---|---|---|---|
| 2009/0302218 | A1 | 12/2009 | Suhara |
| 2010/0196052 | A1 | 8/2010 | Suhara |
| 2012/0059612 | A1 | 3/2012 | Suhara et al. |

FOREIGN PATENT DOCUMENTS

| | | |
|---|---|---|
| JP | 3733166 | 10/2005 |
| JP | 2006-344436 | 12/2006 |
| JP | 2009-037283 | 2/2009 |

* cited by examiner

ONE-DOT GRID PATTERN

TWO-DOT ISOLATED PATTERN

2-BY-2 PATTERN

TWO-DOT LINE PATTERN

|Vace| ≥ |Vp|

|Vace| < |Vp|

(TWO-DOT NORMAL IMAGE)

(TWO-DOT INVERTED IMAGE)

ELECTROSTATIC LATENT IMAGE FORMING METHOD, ELECTROSTATIC LATENT IMAGE FORMING APPARATUS, AND IMAGE FORMING APPARATUS

CROSS-REFERENCE TO RELATED APPLICATIONS

This application is a continuation application of U.S. Ser. No. 14/174,205, filed Feb. 6, 2014, and claims priority to and incorporates by reference the entire contents of Japanese Patent Application No. 2013-044850 filed in Japan on Mar. 7, 2013.

BACKGROUND OF THE INVENTION

1. Field of the Invention

The present invention relates to an electrostatic latent image forming method, an electrostatic latent image forming apparatus, and an image forming apparatus, and more particularly to an electrostatic latent image forming method and an electrostatic latent image forming apparatus for forming electrostatic latent images by using light and to an image forming apparatus that includes the electrostatic latent image forming apparatus.

2. Description of the Related Art

In recent years, the image forming apparatuses capable of forming images in multiple colors have been used for simple printing in an on-demand printing system, and there is a demand for higher-quality images.

For higher-quality images, there is a need to correctly form multiple dots included in an image in accordance with image information, i.e., achieve superior dot reproducibility.

Electrophotographic image forming apparatuses perform a plurality of processes, i.e., a charge process, exposure process, developing process, transfer process, fixing process, or the like, and the quality of the finally output image is highly affected by the accuracy of each of the processes. Particularly, the state of an electrostatic latent image formed on a photosensitive element during an exposure process is important as it directly affects the behavior of toner particles during a developing process.

Therefore, there is a need to correctly form electrostatic latent images in accordance with image information.

For example, Japanese Patent Application Laid-open No. 09-85982 discloses an exposure method performed by a laser beam printer that features printing by changing the amount of irradiation light for a signal dot to be printed in accordance with the number of dots that are adjacent to the single dot to be printed on the left, right, top, and bottom thereof.

Japanese Patent Application Laid-open No. 2004-181868 discloses an image forming apparatus that is characterized in that, if there is a small number of "pixels on which toner is to be formed" in the N×M area in the vicinity of an arbitrary pixel within the image to be printed, the amount of irradiation light for the image is controlled so that "the electric field intensity for developing the toner is increased" and, if there is a large number of "pixels on which toner is to be formed" in the N×M area in the vicinity of the pixel, it is controlled so that "the electric field intensity for developing the toner is decreased".

Furthermore, Japanese Patent Application Laid-open No. 2009-37283 discloses an image processing apparatus that is characterized in that it includes an image-signal input unit that receives an input of an image signal of the image to be processed; a density-reduced area detection unit that uses the image signal input to the image-signal input unit to detect, from the image to be processed, a density-reduced area that satisfies a predetermined image density reduction condition; a specific-image area detection unit that uses the image signal input to the image-signal input unit to detect, from the image to be processed, a specific image area that satisfies a predetermined specific-image condition that is different from the predetermined density reduction condition; and a density control unit that, with respect to a non-specific image area other than the specific image area detected by the specific-image area detection unit, performs a density reduction operation to reduce the image density of the density-reduced area that is detected by the density-reduced area detection unit and that, with respect to the specific image area, does not perform the density reduction operation on the density-reduced area even if the density-reduced area is included therein.

Furthermore, Japanese Patent No. 3733166 discloses a multicolor output device that is characterized in that it includes an image generation unit that generates a bitmap image in each color; an image carrier that has a latent image formed on its surface due to the distribution of an electric potential; a latent-image forming unit that refers to the pixel of interest in the bitmap image and a group of pixels in the vicinity thereof and that, if the pixel of interest is a white pixel and the group of pixels in the vicinity of the pixel of interest includes a pixel that is not white, forms a latent image corresponding to the pixel of interest on the image carrier by using the electric potential that has a predetermined difference from the electric potential corresponding to a white pixel and that does not develop it; and a developing unit that develops the latent image on the image carrier.

However, with the method and apparatuses disclosed in Japanese Patent Application Laid-open No. 09-85982, Japanese Patent Application Laid-open No. 2004-181868, Japanese Patent Application Laid-open No. 2009-37283, and Japanese Patent No. 3733166, it is difficult to form electrostatic latent images of required quality.

SUMMARY OF THE INVENTION

It is an object of the present invention to at least partially solve the problems in the conventional technology.

According to the present invention, there is provided an electrostatic latent image forming method for forming, on an image carrier, an electrostatic latent image that has a pattern where there are an irradiated area and a not-irradiated area in a mixed manner, the electrostatic latent image forming method comprising: adjusting an exposure condition of an irradiated area that is included in the irradiated area and is adjacent to the not-irradiated area so that an electric field intensity of an electrostatic latent image that corresponds to the not-irradiated area is increased so as to prevent adhesion of a developer; and irradiating the image carrier with light under the adjusted exposure condition.

The present invention also provides an electrostatic latent image forming apparatus that forms an electrostatic latent image on an image carrier, the electrostatic latent image forming apparatus comprising: a light source; an optical system configured to guide light emitted by the light source to the image carrier; and an adjustment device configured, during formation of an electrostatic latent image that has a pattern where there are an irradiated area and a not-irradiated area in a mixed manner, to adjust an exposure condition of an irradiated area that is included in the irradiated area and is adjacent to the not-irradiated area so that an electric field intensity of an electrostatic latent image that corresponds to the not-irradiated area is increased so as to prevent adhesion of a developer.

The present invention also provides an image forming apparatus including an electrostatic latent image forming apparatus for forming an electrostatic latent image on the image carrier, wherein the electrostatic latent image forming apparatus comprises; a light source; an optical system configured to guide light emitted by the light source to the image carrier; and an adjustment device configured, during formation of an electrostatic latent image that has a pattern where there are an irradiated area and a not-irradiated area in a mixed manner, to adjust an exposure condition of an irradiated area that is included in the irradiated area and is adjacent to the not-irradiated area so that an electric field intensity of an electrostatic latent image that corresponds to the not-irradiated area is increased so as to prevent adhesion of a developer.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
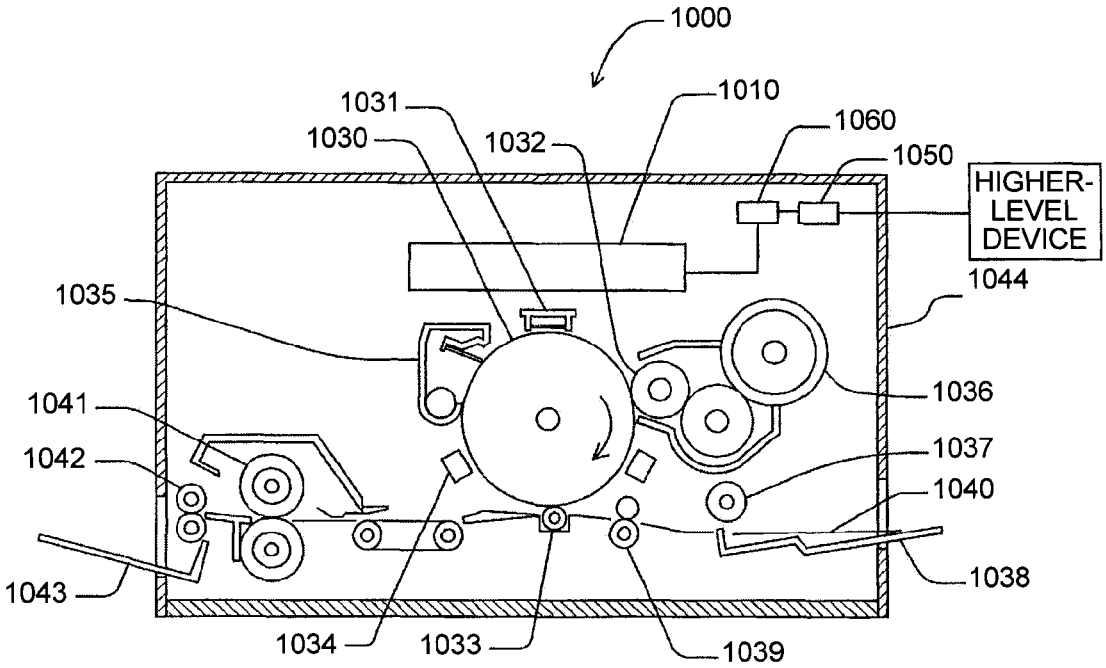
FIG. 1 is a diagram that illustrates a schematic configuration of a laser printer according to an embodiment of the present invention.

Exemplary embodiments of the present invention are explained below in detail with reference to the accompanying drawings (FIGS. 1-44). FIG. 1 illustrates a schematic configuration of a laser printer 1000 that is an image forming apparatus according to an embodiment.

The laser printer 1000 includes, for example, an optical scanning device 1010, a photosensitive drum 1030, a charge device 1031, a developing device 1032, a transfer device 1033, a neutralizing unit 1034, a cleaning unit 1035, a toner cartridge 1036, a sheet feeding roller 1037, a sheet feeding tray 1038, a sheet conveyance roller 1039, a fixing device 1041, a sheet discharge roller 1042, a sheet discharge tray 1043, a communication control device 1050, and a printer control device 1060 that controls the above-described units in an integrated manner. Furthermore, they are contained in a printer chassis 1044 at a predetermined location.

The communication control device 1050 controls a bidirectional communication with a higher-level device (e.g., a personal computer) via a network, or the like.

The printer control device 1060 includes a CPU; a ROM that stores a program that is described in a code readable by the CPU and that stores various types of data that are used when a program is executed; a RAM that is a working memory; an A/D converter that converts analog signals into digital signals; or the like. Furthermore, the printer control device 1060 controls each of the units in response to a request from the higher-level device and sends image information received from the higher-level device to the optical scanning device 1010.

The photosensitive drum 1030 is a cylindrical member and has a photosensitive layer formed on a surface thereof. That is, the surface of the photosensitive drum 1030 is the surface to be scanned. The photosensitive drum 1030 is rotated by an undepicted driving mechanism in the direction of the arrowed line in FIG. 1.

Figure 2A:
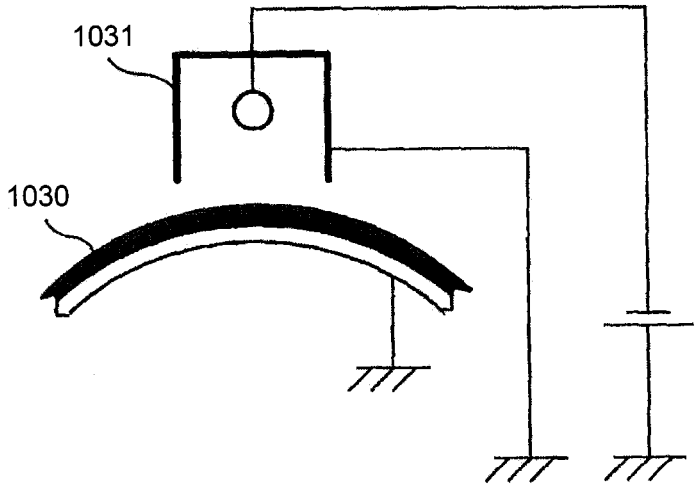
FIGS. 2A and 2B are diagrams that illustrate charge devices.
Figure 2B:
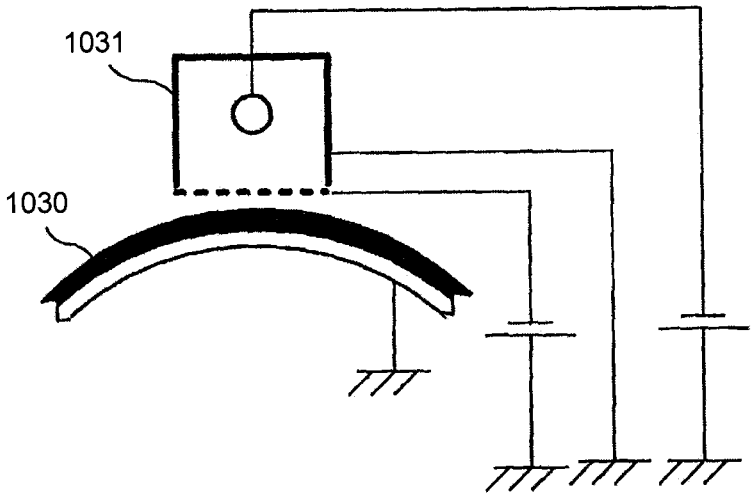

The charge device 1031 uniformly charges the surface of the photosensitive drum 1030. The charge device 1031 may be a corotron-type charge device that is illustrated in FIG. 2A as an example or may be a scorotron-type charge device that is illustrated in FIG. 2B as an example. Furthermore, it may be a roller-type charge device.

With reference back to FIG. 1, in the optical scanning device 1010, the surface of the photosensitive drum 1030 is charged by the charge device 1031 and is scanned by using a light beam that is modulated on the basis of the image information received from the printer control device 1060 so that the electrostatic latent image corresponding to the image information is formed on the surface of the photosensitive drum 1030. The electrostatic latent image formed here is moved toward the developing device 1032 in accordance with the rotation of the photosensitive drum 1030. The optical scanning device 1010 will be explained in detail later.

The toner cartridge 1036 contains toner (developer), and the toner is supplied to the developing device 1032.

The developing device 1032 attaches the toner supplied from the toner cartridge 1036 to a latent image formed on the surface of the photosensitive drum 1030, thereby developing the electrostatic latent image. The image (hereinafter, also referred to as a "toner image" for convenience) to which the toner is attached is moved toward the transfer device 1033 in accordance with the rotation of the photosensitive drum 1030.

The sheet feeding tray 1038 stores a recording sheet 1040. The sheet feeding roller 1037 is provided near the sheet feeding tray 1038, and the sheet feeding roller 1037 delivers the recording sheets 1040 one by one from the sheet feeding tray 1038. The recording sheet 1040 is conveyed, by the sheet conveyance roller 1039, toward the gap between the photosensitive drum 1030 and the transfer device 1033 in synchronization with the rotation of the photosensitive drum 1030.

In order to electrically attract the toner on the surface of the photosensitive drum 1030 to the recording sheet 1040, the voltage applied to the transfer device 1033 has the polarity opposite to that of the toner. By using this voltage, a toner image on the surface of the photosensitive drum 1030 is transferred onto the recording sheet 1040. Here, the recording sheet 1040 onto which the toner image has been transferred is delivered to the fixing device 1041.

In the fixing device 1041, heat and pressure are applied to the recording sheet 1040, whereby the toner is fixed to the recording sheet 1040. Here, the recording sheet 1040 to which the toner is fixed is delivered to the sheet discharge tray 1043 via the sheet discharge roller 1042 and is sequentially stacked on the sheet discharge tray 1043.

The neutralizing unit 1034 neutralizes the surface of the photosensitive drum 1030.

The cleaning unit 1035 removes the toner (residual toner) that remains on the surface of the photosensitive drum 1030. The surface of the photosensitive drum 1030 from which the residual toner has been removed is returned again to the position where it is opposed to the charge device 1031.

Next, an explanation is given of the optical scanning device 1010.

Figure 3:
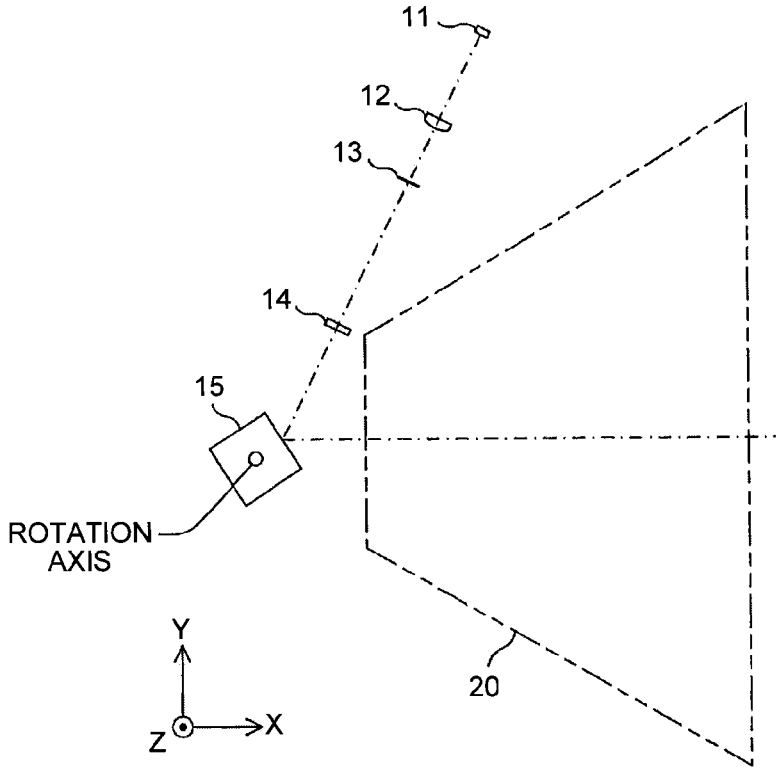
FIG. 3 is a diagram that illustrates an optical scanning device.

As illustrated in FIG. 3, for example, the optical scanning device 1010 includes a light source 11, a coupling lens 12, an apertured plate 13, a cylindrical lens 14, a polygon mirror 15, an optical scanning system 20, a scanning control device (not illustrated), or the like. They are assembled at a predetermined location in an optical housing (not illustrated).

In this specification, an explanation is given by using an XYZ three-dimensional orthogonal coordinate system, where the direction of the axis Y is a direction along the longitudinal direction (the direction of the rotation axis) of the photosensitive drum 1030 and the direction of the axis Z is a direction along the rotation axis of the polygon mirror 15.

In the following, with respect to each of the optical members, the direction corresponding to the main scanning direction is simply referred to as the "corresponding main-scanning direction" for convenience, and the direction corresponding to the sub-scanning direction is simply referred to as the "corresponding sub-scanning direction".

Figure 4:
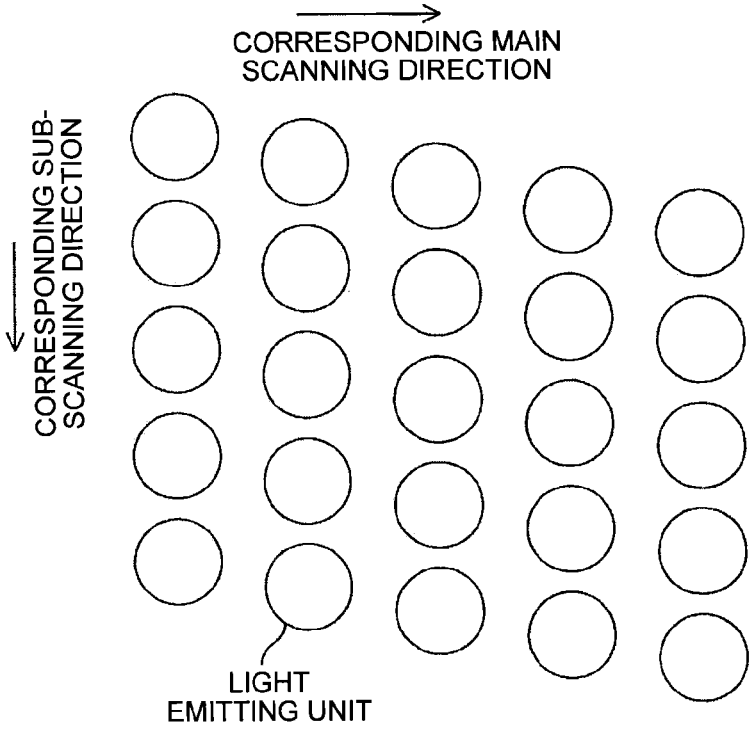
FIG. 4 is a diagram that illustrates a plurality of light emitting units.

As illustrated in FIG. 4, for example, the light source 11 includes 25 light emitting units in a two-dimensional array. The 25 light emitting units are arranged such that, when all of the light emitting units are orthogonally projected on a virtual line that extends in the corresponding sub-scanning direction, the space between the light emitting units is equal. In this specification, the "space between the light emitting units" is the distance between the centers of two light emitting units.

Each of the light emitting units is a surface-emitting laser (VCSEL). That is, the light source 11 includes a surface-emitting laser array. The number of light emitting units is not limited to 25.

The coupling lens 12 is provided on the optical path of light emitted by the light source 11 so as to form the light into a substantially parallel light.

The apertured plate 13 includes an aperture so as to shape the light that passes through the coupling lens 12.

The cylindrical lens 14 focuses the light transmitted through the aperture of the apertured plate 13 into the polygon mirror 15 in the vicinity of a deflection reflectance surface thereof with respect to the direction of the axis Z.

The optical system provided on the optical path between the light source 11 and the polygon mirror 15 is also referred to as a prior-deflector optical system.

The polygon mirror 15 includes a four-sided mirror that is rotated about the rotation axis that is perpendicular to the longitudinal direction of the photosensitive drum 1030 (the direction of the rotation axis). Each of the mirror surfaces of the four-sided mirror is a deflection reflectance surface. The four-sided mirror of the polygon mirror 15 is rotated at a constant velocity so as to deflect the light received from the cylindrical lens 14 at a constant angular velocity.

Figure 5:
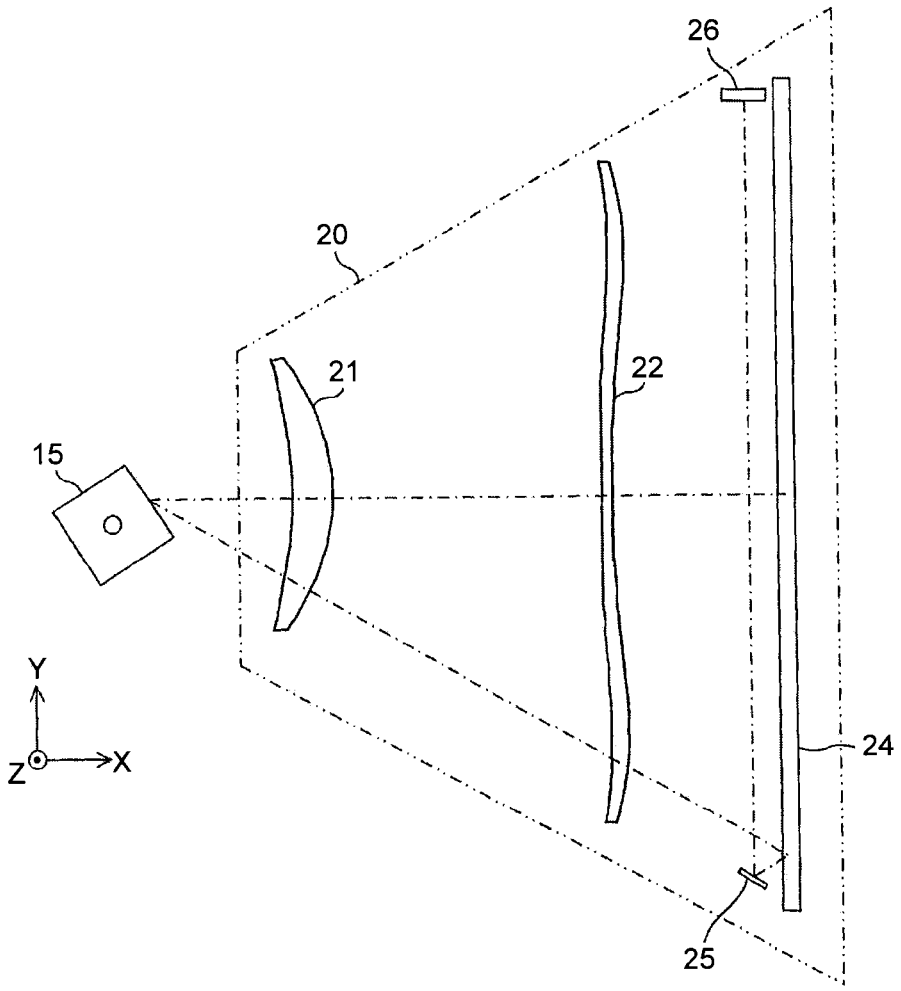
FIG. 5 is a diagram (1) that illustrates an optical scanning system.
Figure 6:
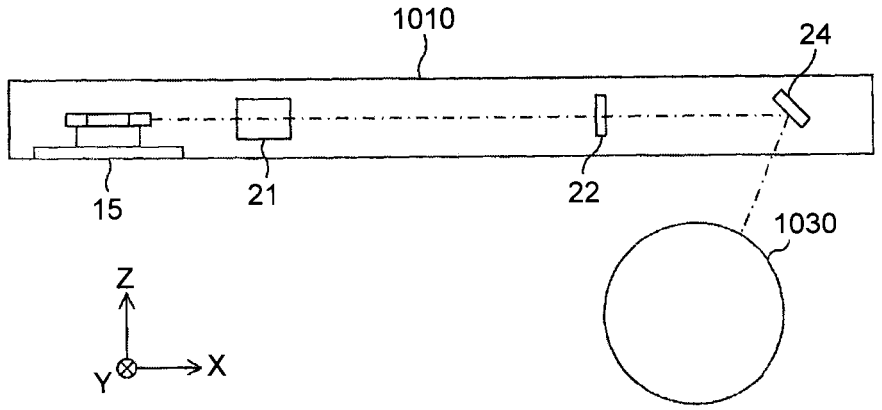
FIG. 6 is a diagram (2) that illustrates an optical scanning system.

The optical scanning system 20 is provided on the optical path of the light deflected by the polygon mirror 15 and, as illustrated in FIGS. 5 and 6, for example, it includes a first scanning lens 21, a second scanning lens 22, a reflection mirror 24, a synchronization detection mirror 25, a synchronization detection sensor 26, or the like.

The first scanning lens 21 is provided on the optical path of the light deflected by the polygon mirror 15.

The second scanning lens 22 is provided on the optical path of the light that passes through the first scanning lens 21.

The reflection mirror 24 reflects the optical path of the light that passes through the second scanning lens 22 in a direction toward the photosensitive drum 1030.

Specifically, the photosensitive drum 1030 is irradiated with the light that is deflected by the polygon mirror 15 and is incident on the first scanning lens 21, the second scanning lens 22, and the reflection mirror 24, whereby an optical spot is formed on the surface of the photosensitive drum 1030.

The optical spot on the surface of the photosensitive drum 1030 is shifted in the longitudinal direction of the photosensitive drum 1030 (the direction of the axis Y) in accordance with the rotation of the polygon mirror 15. Here, the direction in which the optical spot is shifted is the "main scanning direction", and the direction in which the photosensitive drum 1030 is rotated is the "sub-scanning direction".

The synchronization detection mirror 25 reflects the light, which is reflected by the reflection mirror 24 before the start of writing, in a direction (here, the +Y direction) toward the synchronization detection sensor 26. The synchronization detection sensor 26 outputs, to the scanning control device, a signal (photoelectric conversion signal) that corresponds to the amount of received light. In the following, a signal output from the synchronization detection sensor 26 is also referred to as a "synchronization detection signal".

Figure 7:
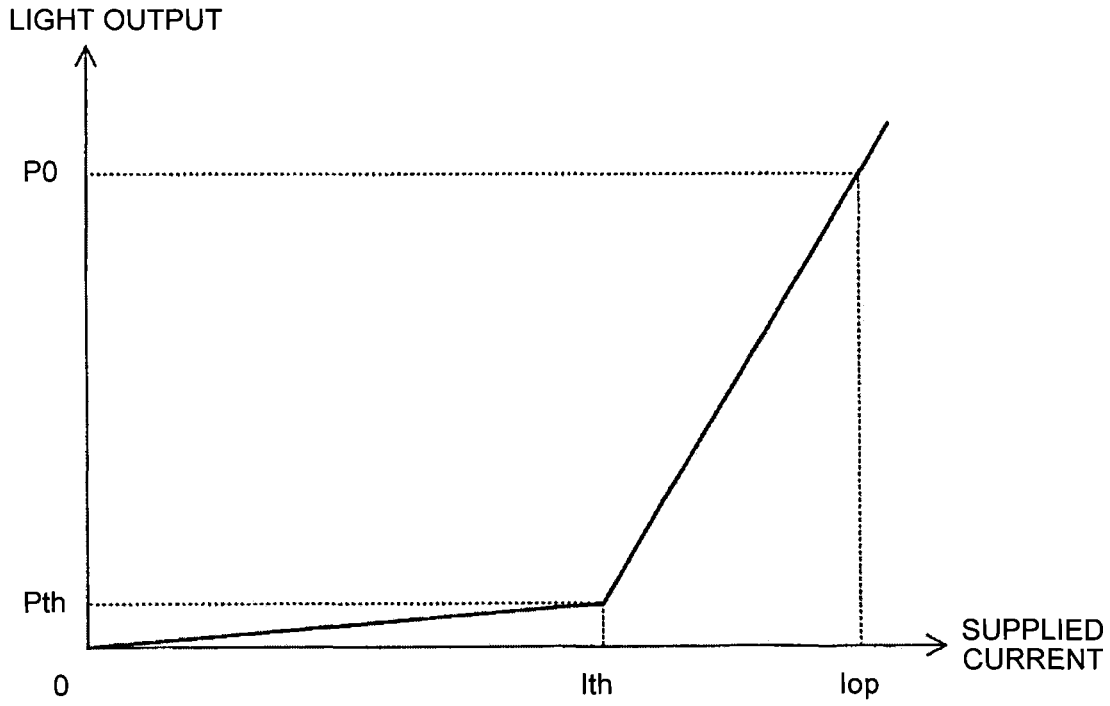
FIG. 7 is a diagram that illustrates the IL characteristics of a semiconductor laser.
Figure 8:
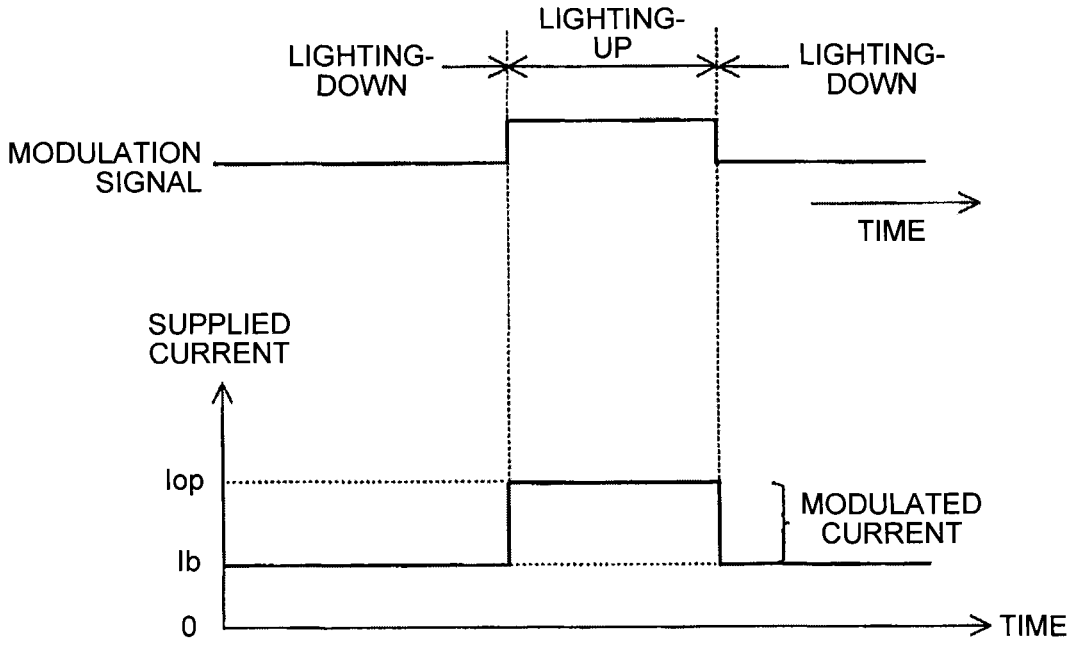
FIG. 8 is a diagram that illustrates a modulated current.

FIG. 7 illustrates the IL characteristics of a semiconductor laser. Before the current (hereafter, simply referred to as a "supplied current") supplied to the semiconductor laser reaches a threshold Ith, a light output is very low and, when the supplied current exceeds the threshold Ith, the light output increases in proportion to the current value. The reference mark Iop in FIG. 7 denotes the current supplied to obtain a predetermined light output PO during lighting-up, and it is also referred to as the "operating current". Furthermore, when the current value is the threshold Ith, the supplied current is also referred to as the "threshold current Ith".

A method for driving a semiconductor laser includes a non-bias method and a bias method. In the non-bias method, the supplied current is set to zero during lighting-down and the operating current Iop is supplied during lighting. Furthermore, in the bias method, a bias current Ib, i.e., a minute electric current of about 1 mA, is always supplied, and the difference between the operating current Iop and the bias current Ib is added during lighting (see FIG. 8). The current added during lighting is called a "modulated current" or "drive current".

In recent years, the processing speed of image forming apparatuses using an electrophotographic system has been rapidly increasing. In a case where a semiconductor laser is driven by using the non-bias method and the threshold Ith thereof is high, it takes a certain time to generate a carrier at such a concentration that enables laser oscillation after the operating current Iop is supplied to the semiconductor laser, which causes a delay of emission.

In this case, if the semiconductor laser is turned on/off at a high speed, there is a possibility that, although the operating current is supplied to the semiconductor laser in accordance with a desired lighting time, the actual lighting time becomes shorter than the desired lighting time. Thus, in the present embodiment, the bias method is used in order to improve the response characteristics.

Figure 9:
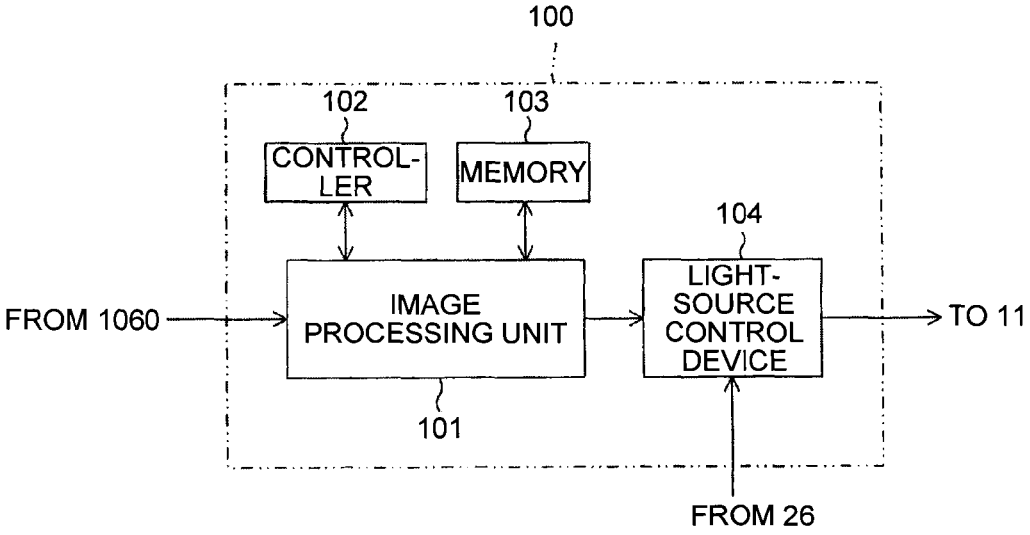
FIG. 9 is a diagram that illustrates an image processing apparatus.

The scanning control device includes an image processing apparatus (an image processing apparatus 100). As illustrated in FIG. 9, for example, the image processing apparatus 100 includes an image processing unit 101, a controller 102, a memory 103, a light-source control device 104, or the like.

The memory 103 stores various types of data that are used for operations performed by the image processing unit 101.

Figure 10:
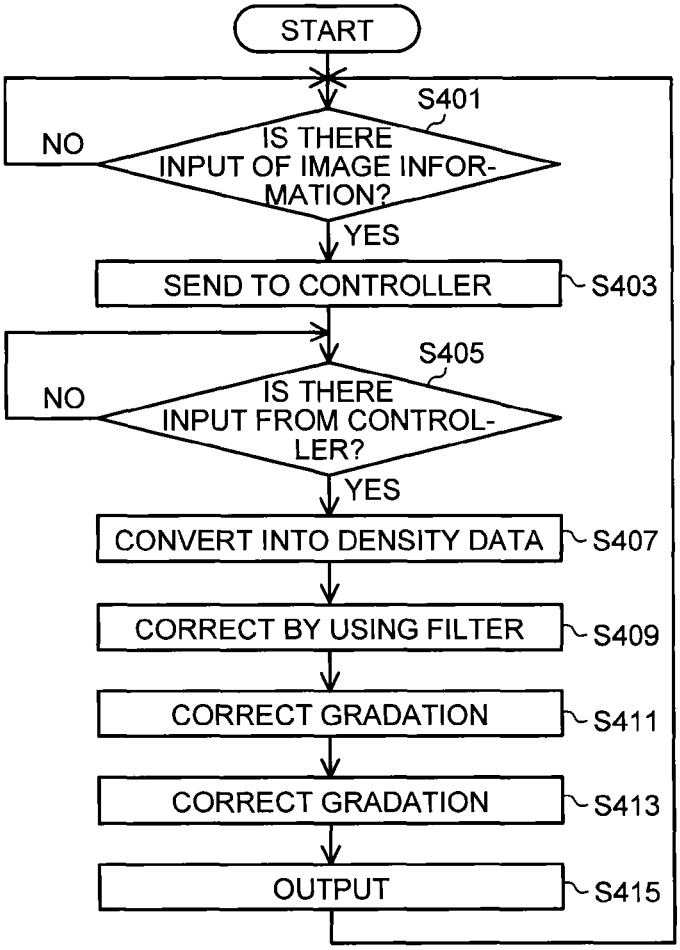
FIG. 10 is a flowchart that illustrates an operation of an image processing unit.

An explanation is given, with reference to FIG. 10, of an operation performed by the image processing unit 101. The flowchart of FIG. 10 corresponds to a sequence of processing algorithms that are executed by the image processing unit 101.

At the first Step S401, it is determined whether or not image information is sent from the printer control device 1060. Here, a standby state is maintained until image information is sent from the printer control device 1060. When image information is sent from the printer control device 1060, a positive determination is made here, and the process proceeds to Step S403.

At Step S403, the image information is sent to the controller 102. The controller 102 performs rotation processing, repeat processing, combining processing, compression/decompression processing, or the like, on the image information and returns the processing result to the image processing unit 101.

At the next Step S405, it is determined whether or not the processing result is returned from the controller 102. Here, a standby state is maintained until the processing result is returned from the controller 102. When the processing result is returned from the controller 102, a positive determination is made here, and the process proceeds to Step S407.

At Step S407, a reference is made to a look-up density table that is previously stored in the memory 103, and the processing result received from the controller 102 is converted into density data.

At the next Step S409, image correction, such as smoothing processing or edge enhancement processing, is performed by using a filter on the above-described density data.

At the next Step S411, a reference is made to a look-up gradation table that is previously stored in the memory 103, and gradation correction is performed on the above-described image-corrected data.

At the next Step S413, gradation processing, such as dither processing, is performed on the above-described gradation-corrected data.

At the next Step S415, the above-described gradation-processed data is output to the light-source control device 104 as image data. Then, the process returns to the above-described Step S401.

The image processing unit 101 may perform the above-described processing by using the CPU and programs or may perform all or some of the above-described processing by using hardware.

Figure 11:
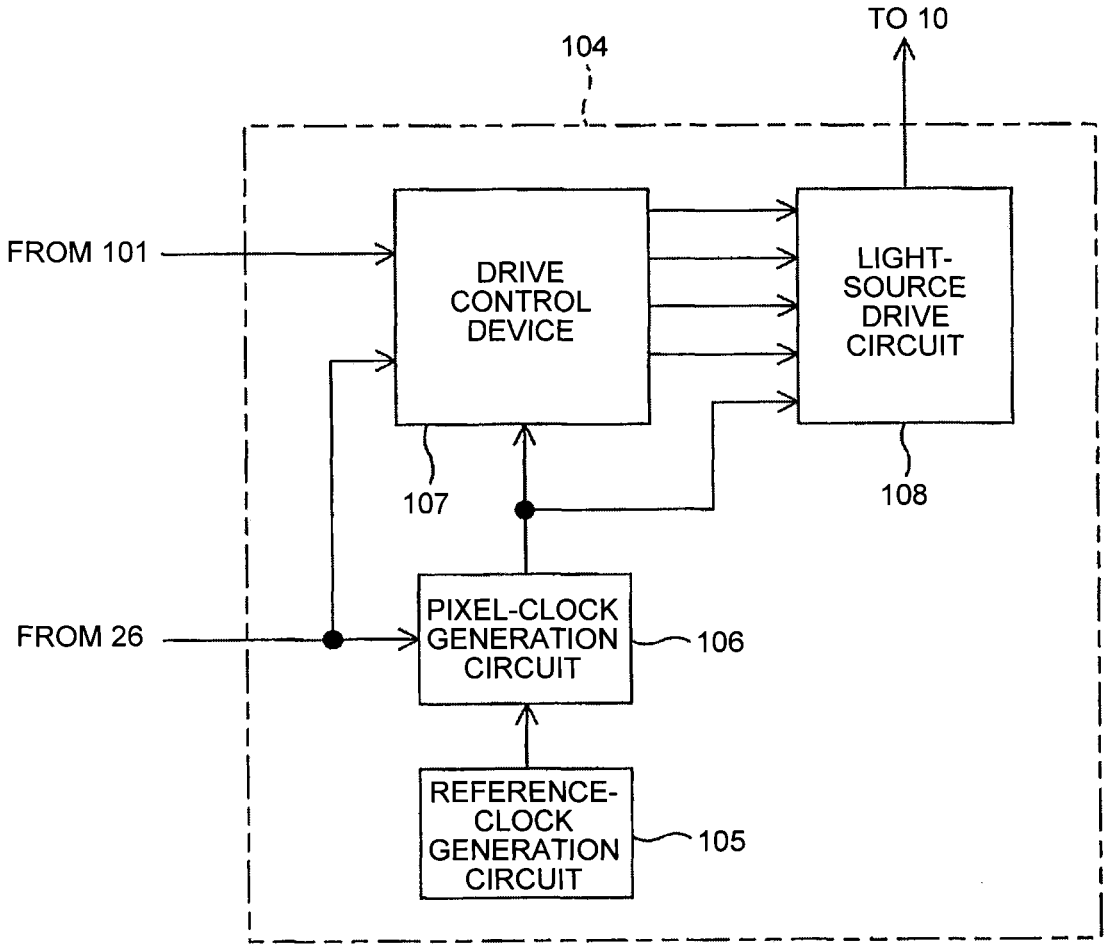
FIG. 11 is a diagram that illustrates a light-source control device.

As illustrated in FIG. 11, for example, the light-source control device 104 includes a reference-clock generation circuit 105, a pixel-clock generation circuit 106, a drive control device 107, a light-source drive circuit 108, or the like. The arrowed line of FIG. 11 indicates the flow of a typical signal or information and does not indicate all of the connection relations of various blocks. Furthermore, a single arrowed line does not always indicate a single signal line.

The reference-clock generation circuit 105 generates a high-frequency clock signal that is used as a reference in the overall light-source control device 104.

The pixel-clock generation circuit 106 includes a phase locked loop (PLL) circuit and generates a pixel clock signal on the basis of a high-frequency clock signal received from the reference-clock generation circuit 105 and a synchronization detection signal received from the synchronization detection sensor 26. The pixel clock signal is output to the drive control device 107 and the light-source drive circuit 108.

Figure 12:
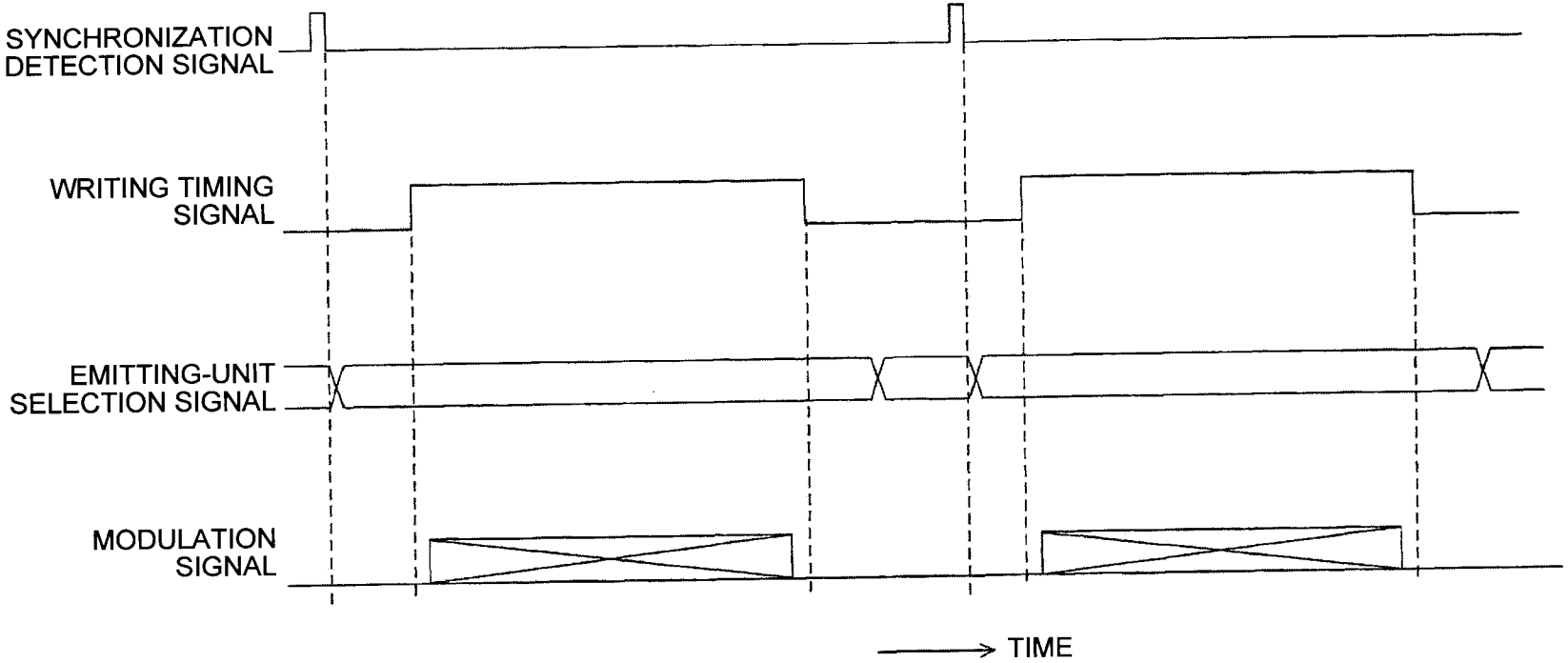
FIG. 12 is a timing chart of a synchronization detection signal, a writing timing signal, an emitting-unit selection signal, and a modulation signal.

The drive control device 107 generates a modulation signal, emitting-unit selection signal, writing timing signal, level signal, or the like, on the basis of image data received from the image processing unit 101, a pixel clock signal received from the pixel-clock generation circuit 106, and a synchronization detection signal received from the synchronization detection sensor 26 and outputs the signal to the light-source drive circuit 108. FIG. 12 illustrates an exemplary timing chart of the synchronization detection signal, the modulation signal, the emitting-unit selection signal, and the writing timing signal.

Figure 13:
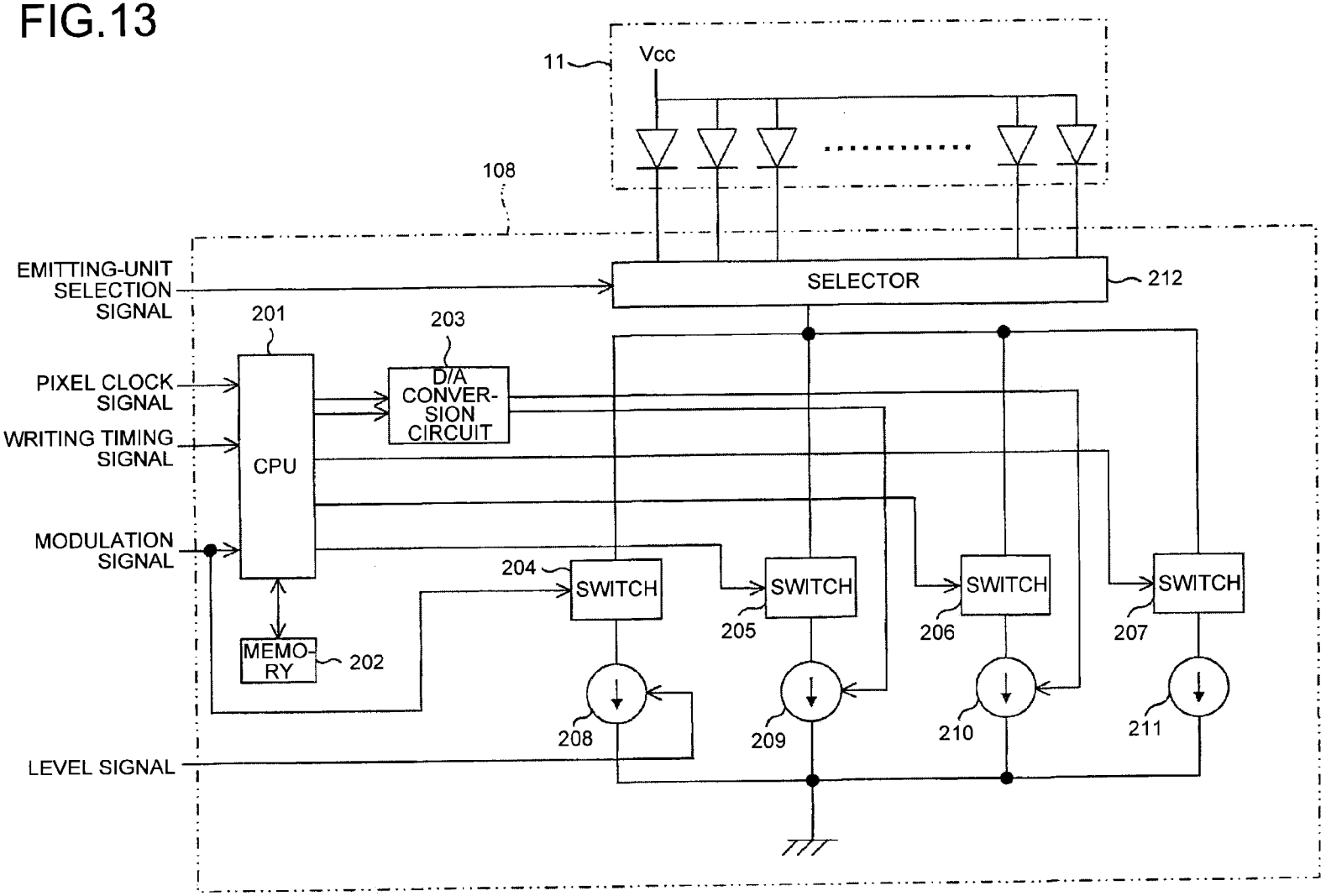
FIG. 13 is a diagram that illustrates a light-source drive circuit.

As illustrated in FIG. 13, for example, the light-source drive circuit 108 includes a CPU 201, a memory 202, a D/A conversion circuit 203, four switches (204, 205, 206, and 207), four current sources (208, 209, 210, and 211), a selector 212, or the like.

Figure 14:
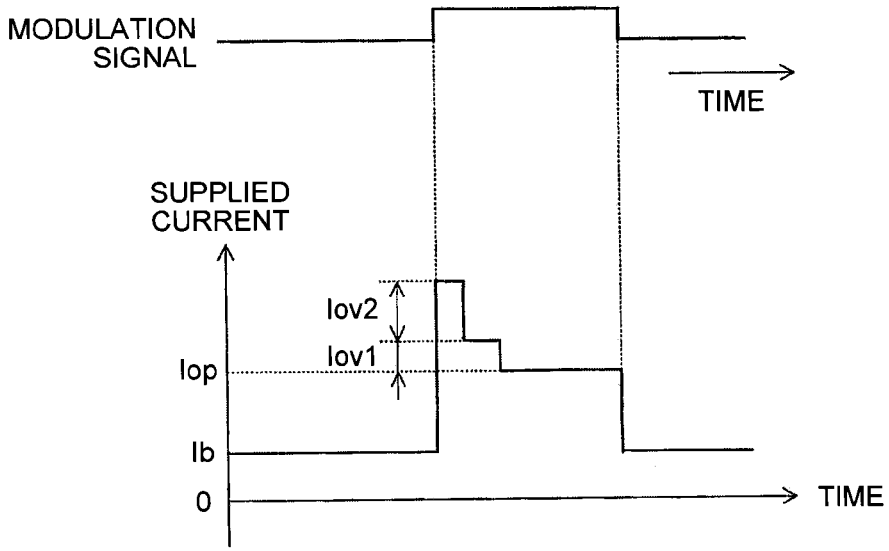
FIG. 14 is a diagram that illustrates overshoot currents.

In the present embodiment, as illustrated in FIG. 14, for example, an overshoot current 1 (Iov1) and an overshoot current 2 (Iov2) can be added to a modulated current.

With reference back to FIG. 13, the memory 202 stores a program that is described in a code readable by the CPU 201 and stores multiple sets of data and set values that are used for executing the program.

The CPU 201 controls the overall operation of the light-source drive circuit 108 in accordance with the program that is stored in the memory 202.

The D/A conversion circuit 203 converts an overshoot level 1 set signal received from the CPU 201 into an analog signal so as to generate an overshoot level 1 signal. Furthermore, the D/A conversion circuit 203 converts an overshoot level 2 set signal received from the CPU 201 into an analog signal so as to generate an overshoot level 2 signal. The information about each of the set signals is previously stored in the memory 202.

The current source 208 is a current source of a modulated current. The magnitude of the modulated current is determined by using a level signal received from the drive control device 107.

The current source 209 is a current source of the overshoot current 1 (Iov1). The magnitude of the overshoot current 1 is determined by using the overshoot level 1 signal.

The current source 210 is a current source of the overshoot current 2 (Iov2). The magnitude of the overshoot current 2 is determined by using the overshoot level 2 signal.

The current source 211 is a current source of a bias current.

The switch 204 is a switch for turning on/off the electric connection with the current source 208, and it is switched on/off by using a modulation signal. Here, according to the settings, the switch 204 is on when the modulation signal is a high level and is off when the modulation signal is a low level.

The switch 205 is a switch for turning on/off the electric connection with the current source 209, and it is switched on/off by using the overshoot level 1 set signal received from the CPU 201. Here, according to the settings, the switch 205 is on when the overshoot level 1 set signal is a high level and is off when the overshoot level 1 set signal is a low level.

The switch 206 is a switch for turning on/off the electric connection with the current source 210, and it is switched on/off by using the overshoot level 2 set signal received from the CPU 201. Here, according to the settings, the switch 206 is on when the overshoot level 2 set signal is a high level and is off when the overshoot level 2 set signal is a low level.

The switch 207 is a switch for turning on/off the electric connection with the current source 211, and it is switched on/off by using a bias signal received from the CPU 201. Here, according to the settings, the switch 207 is on when the bias signal is a high level and is off when the bias signal is a low level.

Figure 15:
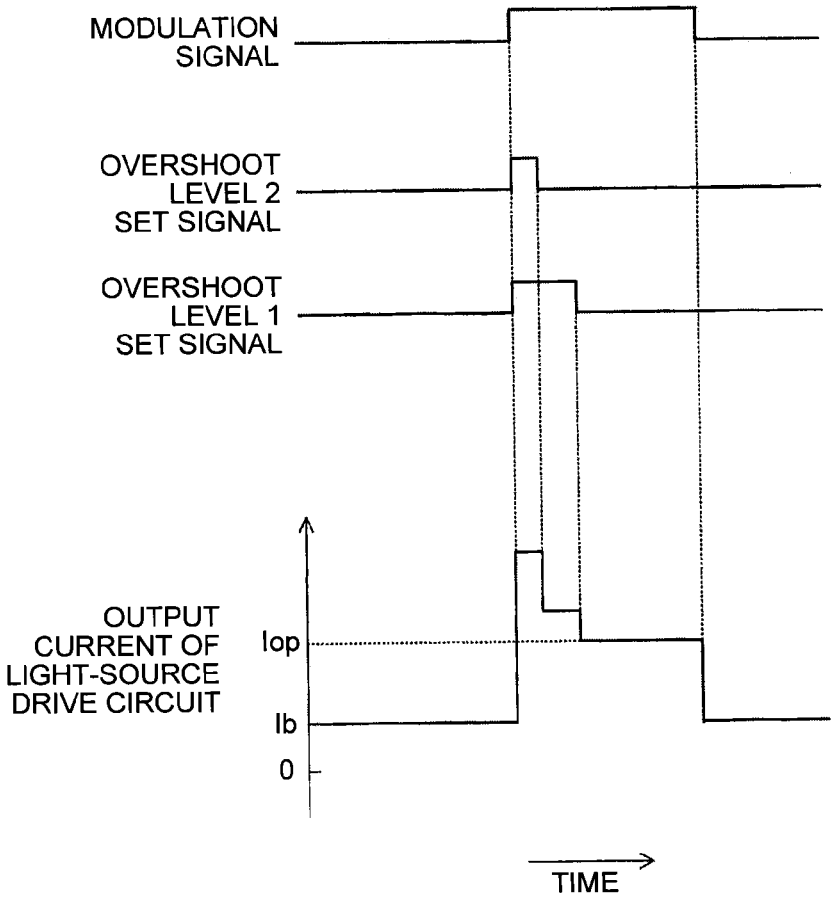
FIG. 15 is a timing chart of a modulation signal, an overshoot level 1 set signal, an overshoot level 2 set signal, and the current output from the light-source drive circuit.

FIG. 15 illustrates an exemplary timing chart of the modulation signal, the overshoot level 1 set signal, the overshoot level 2 set signal, and the current output from the light-source drive circuit 108.

With reference back to FIG. 13, the selector 212 uses the emitting-unit selection signal received from the drive control device 107 to select one of the 25 light emitting units in the light source 11. Here, the current output from the light-source drive circuit 108 is supplied to only the light emitting unit that is selected above.

Figure 16:
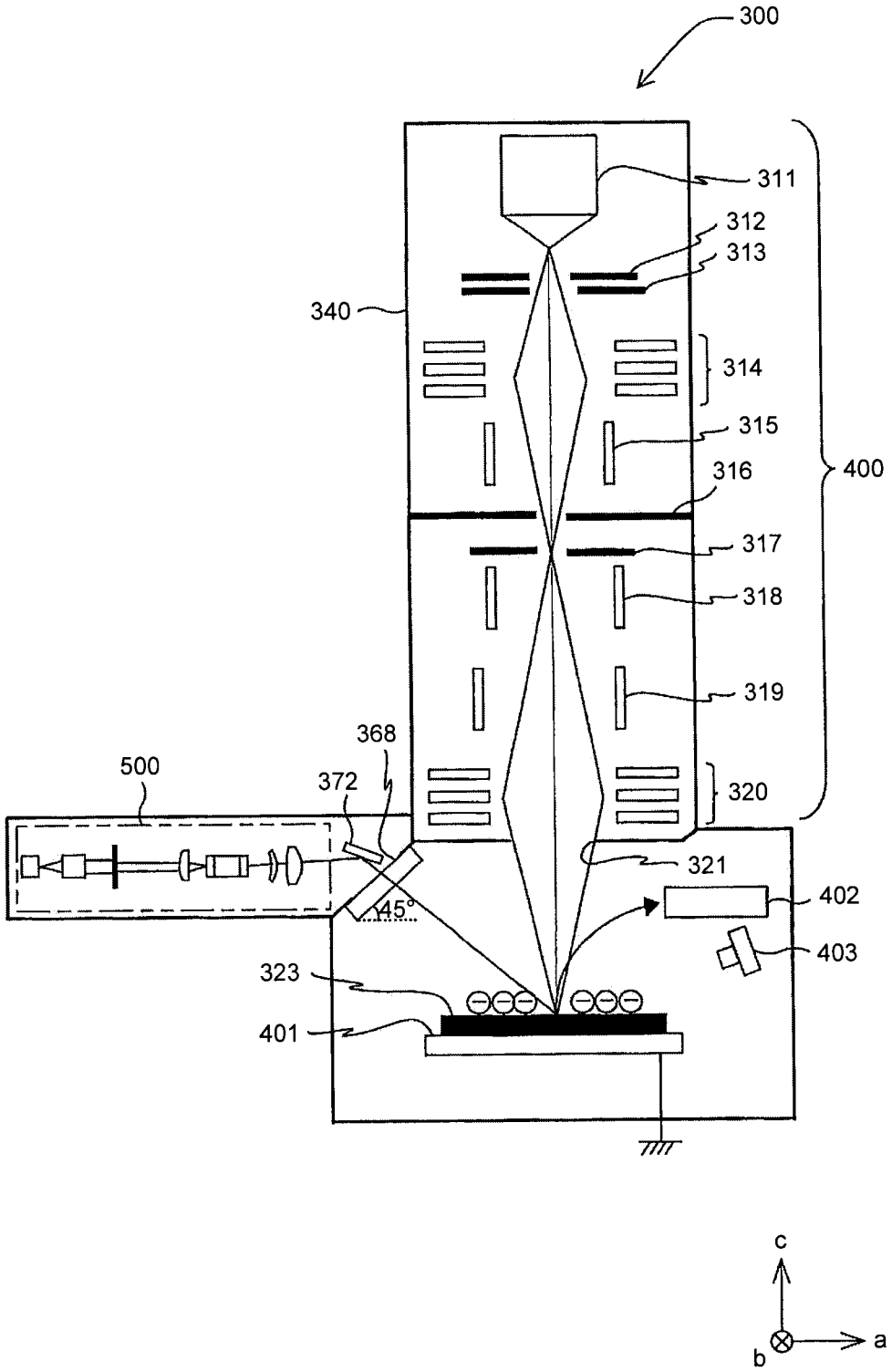
FIG. 16 is a diagram that illustrates a schematic configuration of an electrostatic latent image measurement device.

Next, an explanation is given of an electrostatic latent image measurement device. FIG. 16 illustrates a schematic configuration of an electrostatic latent image measurement device 300.

The electrostatic latent image measurement device 300 includes a charged-particle irradiation system 400, an exposure system 500, a specimen stage 401, a detector 402, an LED 403, a control system 303 (not illustrated in FIG. 16, see FIG. 18), a discharge system (not illustrated), a driving electric source (not illustrated), or the like.

The charged-particle irradiation system 400 includes an electron gun 311, an extraction electrode 312, an acceleration electrode 313, a condenser lens 314, a beam blanker 315, a partition plate 316, a movable aperture 317, a stigmator 318, a scanning lens 319, and an objective lens 320, which are provided within a vacuum chamber 340. An explanation is given in this specification where the direction of the axis c is the direction of the optical axis of each lens and the directions of the axis a and the axis b are the two directions that run at right angles to each other on the plane that is perpendicular to the direction of the axis c.

The electron gun 311 generates an electron beam that is a charged-particle beam.

The extraction electrode 312 is provided on the −c side of the electron gun 311 so as to control the electron beam generated by the electron gun 311.

The acceleration electrode 313 is provided on the −c side of the extraction electrode 312 so as to control the energy of the electron beam.

The condenser lens 314 is provided on the −c side of the acceleration electrode 313 so as to converge the electron beam.

The beam blanker 315 is provided on the −c side of the condenser lens 314 so as to turn on/off the irradiation of the electron beam.

The partition plate 316 is provided on the −c side of the beam blanker 315 and has an opening at the center thereof.

The movable aperture 317 is provided on the −c side of the partition plate 316 so as to adjust the beam diameter of the electron beam that passes through the opening of the partition plate 316.

The stigmator 318 is provided on the −c side of the movable aperture 317 so as to correct astigmatism.

The scanning lens 319 is provided on the −c side of the stigmator 318 so as to deflect the electron beam that passes through the stigmator 318 within the plane ab.

The objective lens 320 is provided on the −c side of the scanning lens 319 so as to converge the electron beam that passes through the scanning lens 319. The electron beam that passes through the objective lens 320 is passed through a beam emission opening 321 so that the surface of a specimen 323 is irradiated with the electron beam.

An undepicted driving electric source is connected to each of the lenses, or the like.

The charged particle means a particle that is affected by an electric field or magnetic field and, for example, an ion beam may be used instead of the electron beam. In such a case, a liquid metal ion gun, or the like, is used instead of the electron gun.

Figure 17A:
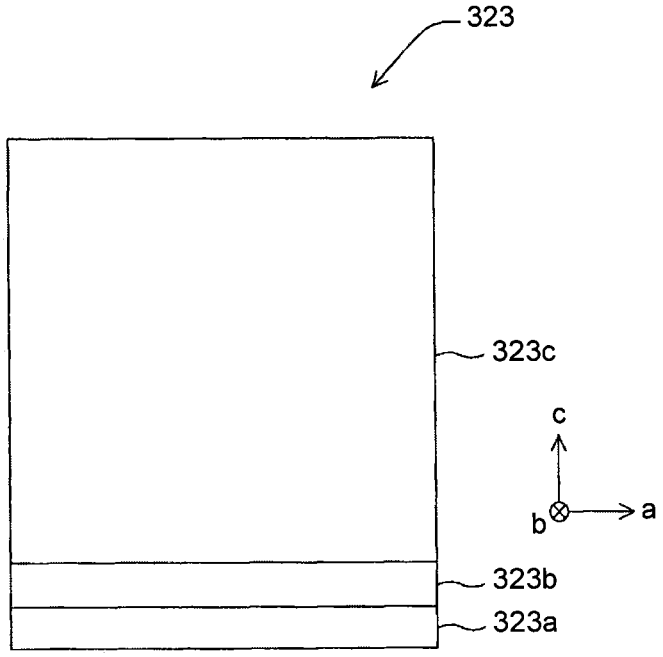
FIG. 17A is a diagram that illustrates a configuration of a specimen.
Figure 17B:
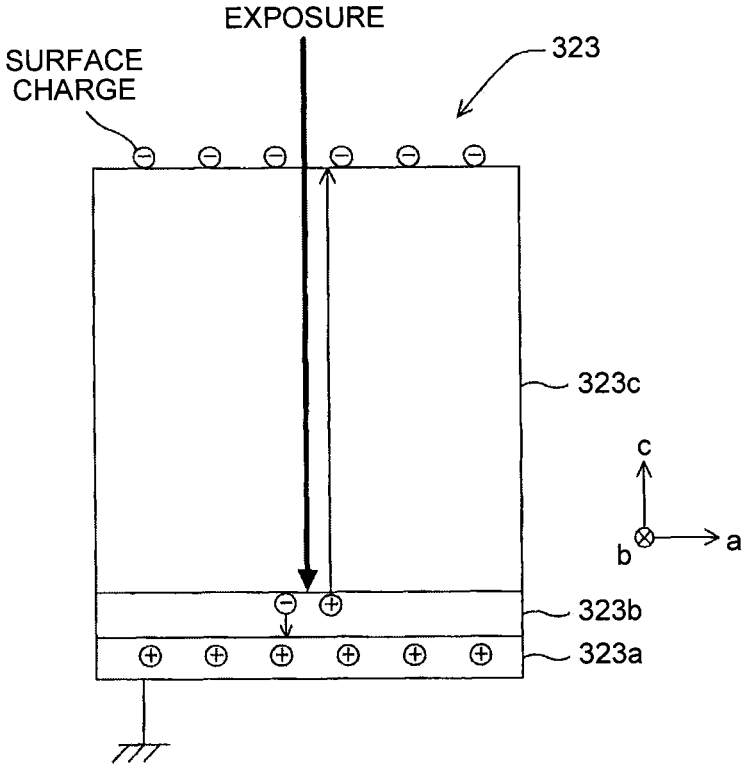
FIG. 17B is a diagram that illustrates the state of the specimen when it is irradiated with light.

The specimen 323 is a photosensitive element and, as illustrated in FIG. 17A, for example, it includes a conductive support 323*a*, a charge generation layer (CGL) 323*b*, and a charge transport layer (CTL) 323*c*.

The charge generation layer (CGL) 323*b* includes a charge generation material (CGM) and is formed on the surface of the conductive support 323*a* on the +c side. The charge transport layer (CTL) 323*c* is formed on the surface of the charge generation layer (CGL) 323*b* on the +c side.

When the specimen 323 is irradiated with light in a state where the surface thereof (the surface on the +c side) is electrically charged, the light is absorbed by the charge generation material (CGM) of the charge generation layer (CGL) 323*b*, and charge carriers that have two polarities, i.e., positive and negative, are generated. Due to the electric field, one of the carriers moves to the charge transport layer (CTL) 323*c*, and the other one moves to the conductive support 323*a* (see FIG. 17B).

The carrier that enters the charge transport layer (CTL) 323*c* is moved to the surface of the charge transport layer (CTL) 323*c* due to the electric field, is combined with the charge on the surface, and is then vanished. Thus, a charge distribution, i.e., an electrostatic latent image, is formed on the surface (the surface on the +c side) of the specimen 323.

With reference back to FIG. 16, the exposure system 500 includes a light source, a coupling lens, an apertured plate, a cylindrical lens, a polygon mirror, an optical scanning system, or the like, in the same manner as the optical scanning device 1010. Furthermore, the exposure system 500 includes a scanning mechanism (not illustrated) for optical scanning with respect to a direction parallel to the rotation axis of the polygon mirror.

The light is emitted by the exposure system 500 and is then incident on a reflection mirror 372 and a window glass 368 so that the surface of the specimen 323 is irradiated with the light.

Due to deflection of the polygon mirror and deflection of the scanning mechanism, the irradiation location of the light that is emitted by the exposure system 500 and is incident on the surface of the specimen 323 is changed in the two directions that run at right angles to each other on the plane that is perpendicular to the direction of the axis c. Here, the direction in which the irradiation location is changed due to deflection of the polygon mirror is the main scanning direction, and the direction in which the irradiation location is changed due to deflection of the scanning mechanism is the sub-scanning direction. Here, according to the settings, the direction of the axis a is the main scanning direction, and the direction of the axis b is the sub-scanning direction.

Thus, it is possible to perform a two-dimensional scanning of the surface of the specimen 323 by using the light emitted by the exposure system 500. That is, it is possible to form a two-dimensional electrostatic latent image on the surface of the specimen 323.

Furthermore, the exposure system 500 is located outside the vacuum chamber 340 in order to prevent any effects on the trajectory of the electron beam due to the vibration or electromagnetic wave that is generated by a drive motor of the polygon mirror. Thus, it is possible to prevent any effects on a measurement result due to disturbance.

The detector 402 is provided near the specimen 323 so as to detect secondary electrons from the specimen 323.

The LED 403 is provided near the specimen 323 so as to emit light with which the specimen 323 is irradiated. The LED 403 is used to remove the charge that remains on the surface of the specimen 323 after measurement.

Figure 18:
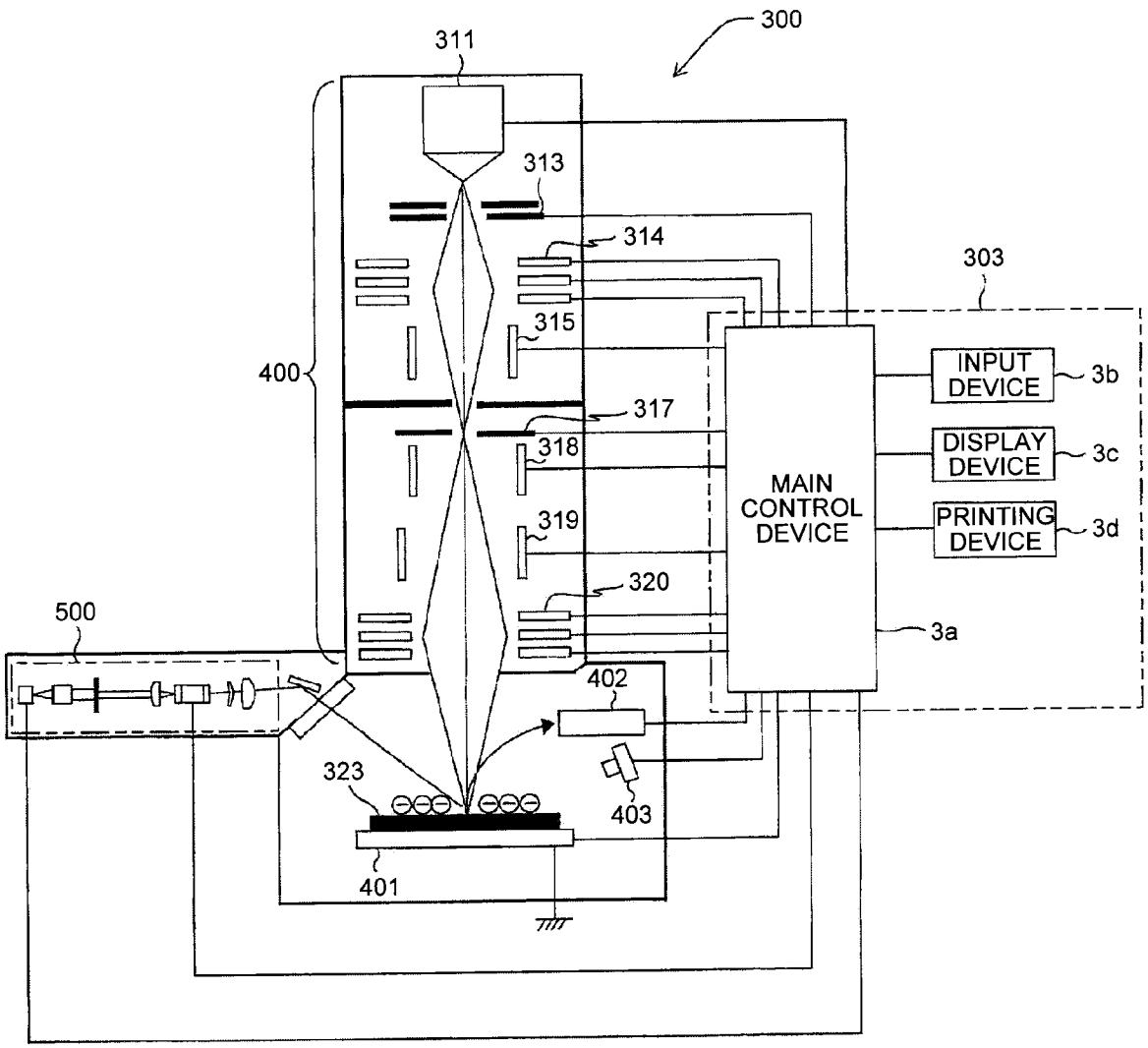
FIG. 18 is a diagram that illustrates a schematic configuration of a control system and the relation between the control system and each unit.
Figure 19:
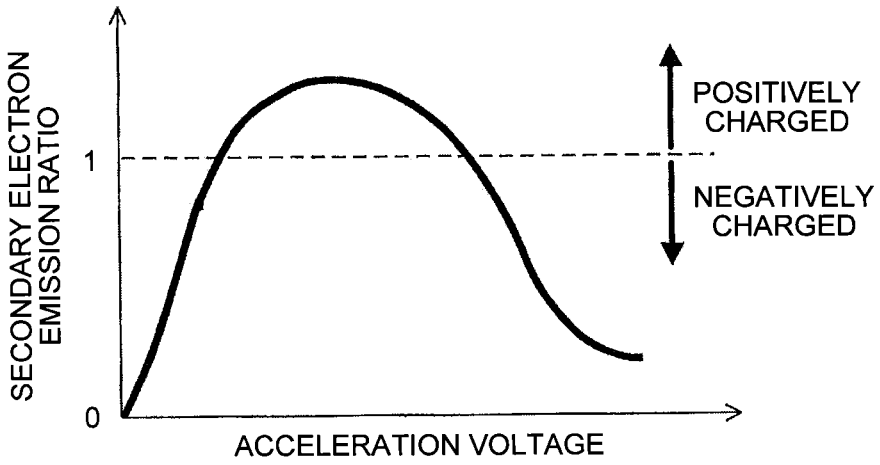
FIG. 19 is a diagram that illustrates the relation between the acceleration voltage and the secondary electron emission ratio.
Figure 20:
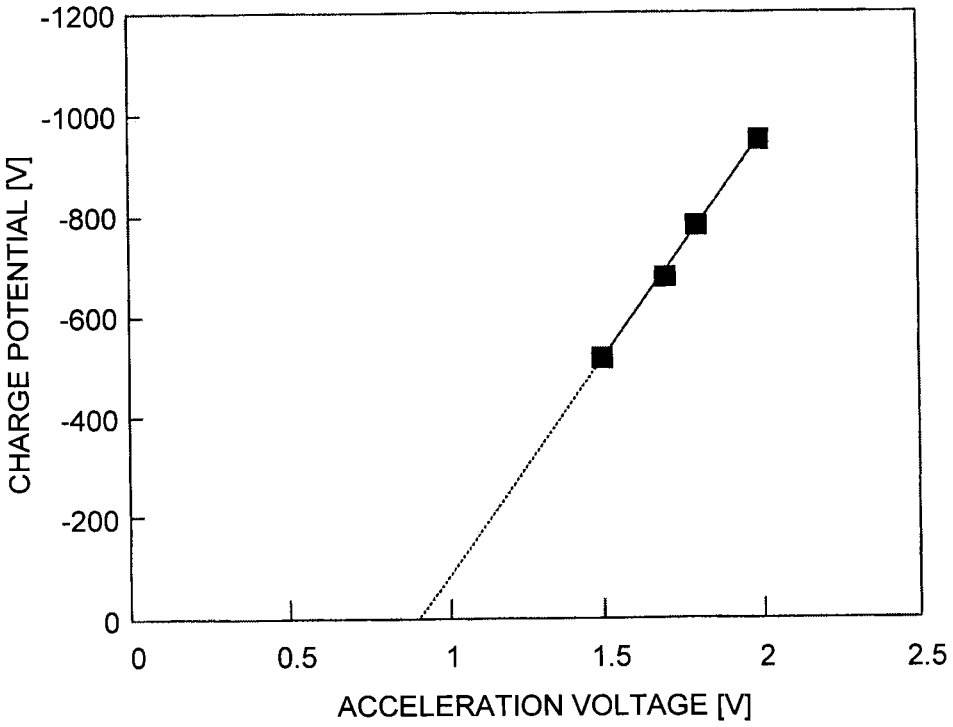
FIG. 20 is a diagram that illustrates the relation between the acceleration voltage and the charge potential.
Figure 21A:
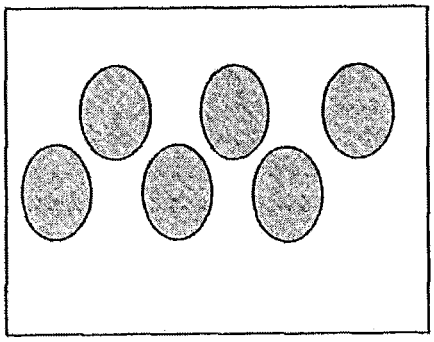
FIGS. 21A to 21D are diagrams that illustrate exemplary patterns of an electrostatic latent image that can be formed by using an exposure system.
Figure 21B:
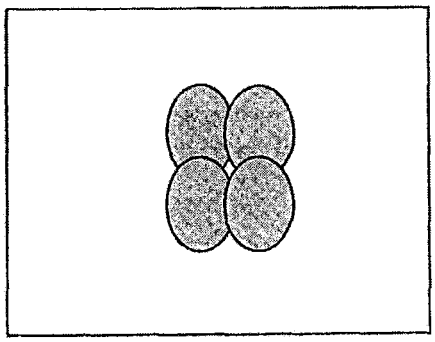
Figure 21C:
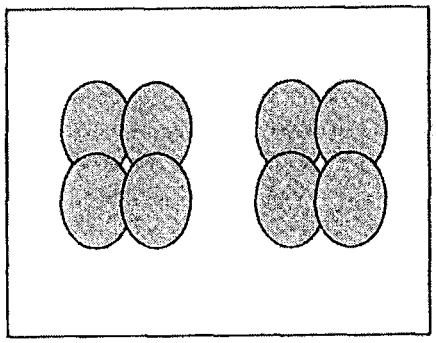
Figure 21D:
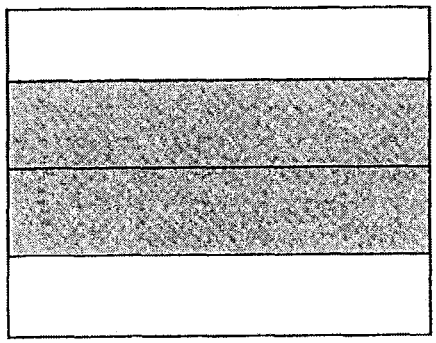

As illustrated in FIG. 18, the control system 303 includes a main control device 3*a*, an input device 3*b*, a display device 3*c*, a printing device 3*d*, or the like.

The input device 3*b* includes an input medium, such as a keyboard, so as to notify the main control device 3*a* of various types of information that are input by an operator.

The display device 3*c* includes a display unit, such as a liquid crystal display, so as to display various types of information that are commanded by the main control device 3*a*.

The printing device 3*d* includes a printer so as to print out various types of information commanded by the main control device 3*a* onto a sheet, or the like.

The main control device 3*a* includes a CPU; a ROM that stores, for example, a program that is described in a code readable by the CPU and various types of data that are used when the program is executed; a RAM that is a working memory; an A/D converter that converts an analog signal into a digital signal; or the like, so as to control each of the units of the electrostatic latent image measurement device 300 in an integrated manner.

The main control device 3*a* controls the electron gun 311, the acceleration electrode 313, the condenser lens 314, the beam blanker 315, the movable aperture 317, the stigmator 318, the scanning lens 319, the objective lens 320, the discharge system, or the like, in the charged-particle irradiation system 400.

Furthermore, the main control device 3*a* controls the light source, the drive motor of the polygon mirror, or the like, in the exposure system 500.

Furthermore, the main control device 3*a* performs a drive control on the specimen stage 401 in the directions of the three axes a, b, and c. Moreover, the main control device 3*a* acquires a signal output from the detector 402.

The electrostatic latent image measurement device 300 configured as described above is provided by using an undepicted anti-vibration table.

Next, an explanation is given of an operation performed by the main control device 3*a* during an electrostatic latent image measurement process that is performed by using the electrostatic latent image measurement device 300. The specimen 323 has been already placed on the specimen stage 401 by an operator.

Furthermore, a predetermined degree of vacuum has been already generated within the vacuum chamber 340.

1. The charged-particle irradiation system 400 is controlled so that the specimen 323 is irradiated with an electron beam and the surface of the specimen 323 is uniformly charged.

Here, an acceleration voltage |Vacc| that is the voltage applied to the acceleration electrode 313 is set to be higher (see FIG. 19) than the voltage with which the secondary electron emission ratio of the specimen 323 is 1. Thus, the number of incident electrons in the specimen 323 exceeds the number of ejected electrons; therefore, the electrons are accumulated in the specimen 323 and charge-up is generated. As a result, the surface of the specimen 323 can be uniformly negatively charged.

An acceleration voltage and a charge potential have a certain relationship (see FIG. 20); therefore, by setting an appropriate acceleration voltage and an appropriate irradiation time, it is possible to form a charge potential on the surface of the specimen 323 in the same manner as that on the photosensitive drum 1030 in the laser printer 1000. Furthermore, it is possible to obtain a target charge potential in a shorter time if the irradiation current is higher; therefore, the irradiation current is here set to a few nA.

2. In order to observe an electrostatic latent image, the number of incident electrons in the specimen 323 is set in the range from a hundredth part to a thousandth part.

3. The exposure system 500 is controlled so that two-dimensional optical scanning is performed on the surface of the specimen 323 and an electrostatic latent image is formed on the specimen 323. The exposure system 500 is adjusted such that an optical spot that has a predetermined beam diameter and beam profile is formed on the surface of the specimen 323.

The exposure energy required to form an electrostatic latent image is determined in accordance with the sensitivity characteristics of a specimen, usually about 2 $mJ/m^2$ to 10 $mJ/m^2$. If a specimen has low sensitivity, the required exposure energy may be a ten and several $mJ/m^2$. A charge potential and required exposure energy are set in accordance with the sensitivity characteristics of a specimen or process conditions. Here, the exposure condition is set in accordance with the laser printer 1000.

Furthermore, various patterns can be formed as image patterns, known as a one-dot isolated pattern, a one-dot grid pattern (see FIG. 21A), a two-dot isolated pattern (see FIG. 21B), a 2-by-2 pattern (see FIG. 21C), a two-dot line pattern (see FIG. 21D), or the like.

4. The charged-particle irradiation system 400 is controlled so that the surface of the specimen 323 on which the electrostatic latent image is formed is scanned by using an electron beam and the secondary electrons released from the specimen 323 are detected by the detector 402. At that time, synchronization is established with a scanning signal to the scanning lens 319, whereby each scanning location can be associated with the number of secondary electrons detected at that location.

5. The contrast image of an electrostatic latent image is generated on the basis of a signal output from the detector 402 (see, for example, Japanese Patent No. 4559063). Here, the number of secondary electrons detected at the charged area of the specimen 323 is large, and the number of secondary electrons detected at the irradiated area is small; therefore, a light-dark contrast image can be obtained. The dark area of the contrast image can be determined to be the area irradiated with light, i.e., the area of an electrostatic latent image.

If there is a charge distribution on the surface of the specimen 323, an electric field distribution corresponding to the surface charge distribution is formed in a space above the specimen 323. The secondary electrons generated due to the incident electrons are pushed backward by the electric field; therefore, the number of secondary electrons that reach the detector 402 is decreased. In the charge leak area, the irradiated area is black and the not-irradiated area is white; thus, the contrast image corresponding to the surface charge distribution can be obtained.

Figure 22A:
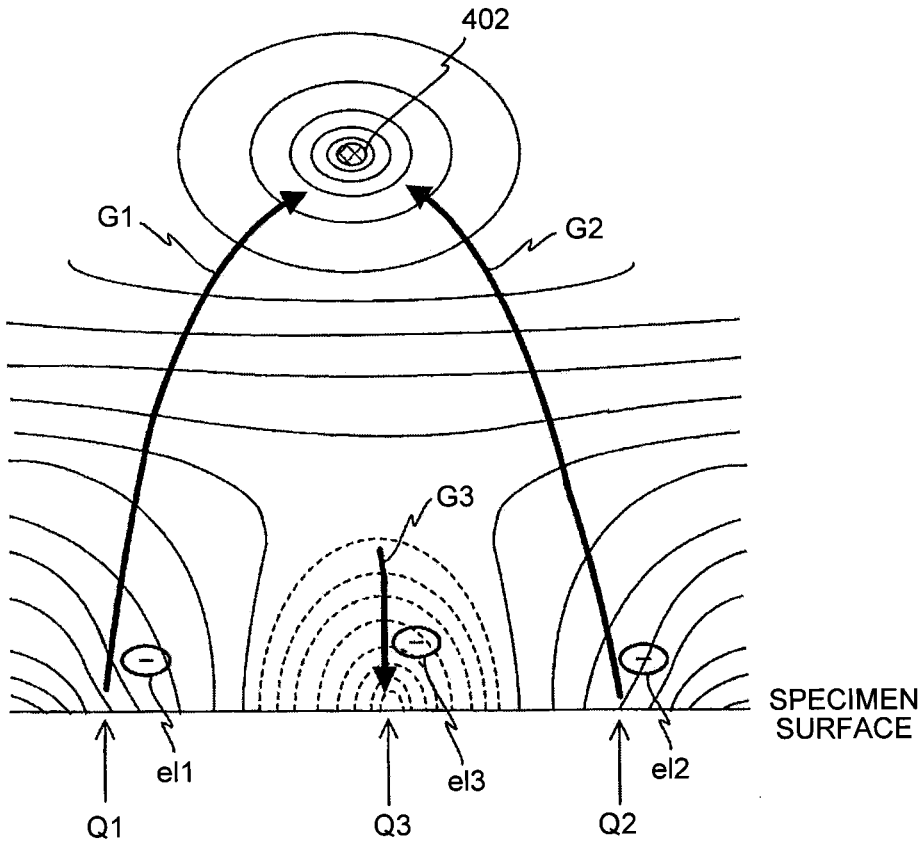
FIGS. 22A and 22B are diagrams that illustrate the effect on the behavior of secondary electrons due to the surface potential distribution.

FIG. 22A is an explanatory contour diagram of the electric potential distribution in the space between the specimen 323 and the detector 402 that captures charged particles. The surface of the specimen 323 is uniformly negatively charged except for the area where the electric potential is decreased due to light attenuation, and a positive electric potential is applied to the detector 402. Therefore, in the group of potential contour lines that are indicated by the solid line, the electric potential becomes higher as it is located closer to the detector 402 and away from the surface of the specimen 323. Therefore, when secondary electrons e11 and e12 are generated at points Q1 and Q2 of the uniformly negatively charged area of the specimen 323, they are attracted by the positive electric potential of the detector 402, are shifted as indicated by the arrowed lines G1 and G2, and are captured by the detector 402.

Conversely, as illustrated in FIG. 22A, a point Q3 is the area where light is incident and the negative electric potential is decreased, and the arrangement of the potential contour lines in the vicinity of the point Q3 is a semi-circular wave shape that is expanded with the point Q3 at the center, as indicated by the dashed line. In this wavelike electric potential distribution, the electric potential becomes higher as it is located closer to the point Q3. In other words, an electric force acts on a secondary electron e13 that is generated in the vicinity of the point Q3 so as to restrain it on the side of the specimen 323, as indicated by the arrowed line G3. Thus, the secondary electron e13 is captured within a hole of the potential indicated by the dashed potential contour line and cannot be moved toward the detector 402.

Figure 22B:
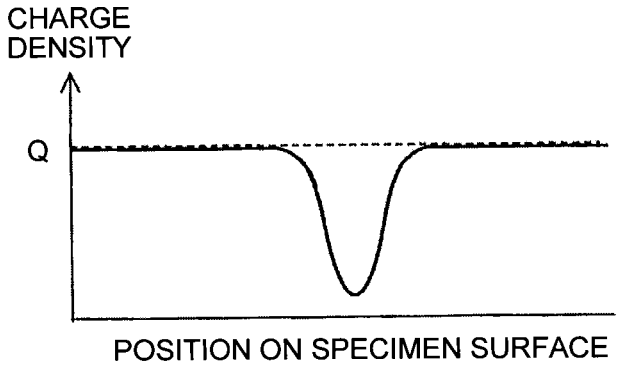

FIG. 22B schematically illustrates the above-described hole of the potential. Specifically, with regard to the intensity of secondary electrons (the number of secondary electrons) that are detected by the detector 402, the high-intensity area corresponds to "the blank area of the electrostatic latent image (the uniformly negatively charged area, typically, the area of the points Q1 and Q2 in FIG. 22A)", and the low-intensity area corresponds to "the image area of the electrostatic latent image (the area irradiated with light, typically, the area of the point Q3 in FIG. 22A)".

Therefore, if the electric signal that is obtained from an output of the detector 402 is sampled in an appropriate sampling time period, a sampling time T is used as a parameter, and thus a surface potential distribution (a potential contrast image) V(a, b) can be determined for each "micro region corresponding to sampling". The surface potential distribution V(a, b) is configured as two-dimensional image data; thus, it may be displayed on a display unit in the display device 3*c*, or it may be printed by a printer in the printing device 3*d* so as to obtain the electrostatic latent image as a visible image.

For example, if the intensity of the captured secondary electron is "represented by using the brightness level", the contrast is obtained such that the image area of the electrostatic latent image is dark and the blank area thereof is bright, and the brightness image corresponding to the surface charge distribution can be represented (output). It is certain that, if the surface potential distribution can be determined, the surface charge distribution can be also determined.

By obtaining the profile of the surface charge distribution or the surface potential distribution, it is possible to measure an electrostatic latent image with a higher accuracy.

Furthermore, an object detected by the detector 402 is not limited to secondary electrons from the specimen 323. For example, the detector 402 may detect an electron that acts repulsively (hereafter, also referred to as a "primary repulsive electron") in the vicinity of the surface of the specimen 323 before an incident electron beam reaches the surface of the specimen 323 (for example, see Japanese Patent No. 4702880, Japanese Patent No. 5089865, and Japanese Patent No. 5116134). An explanation is given below of the above case.

Figure 23:
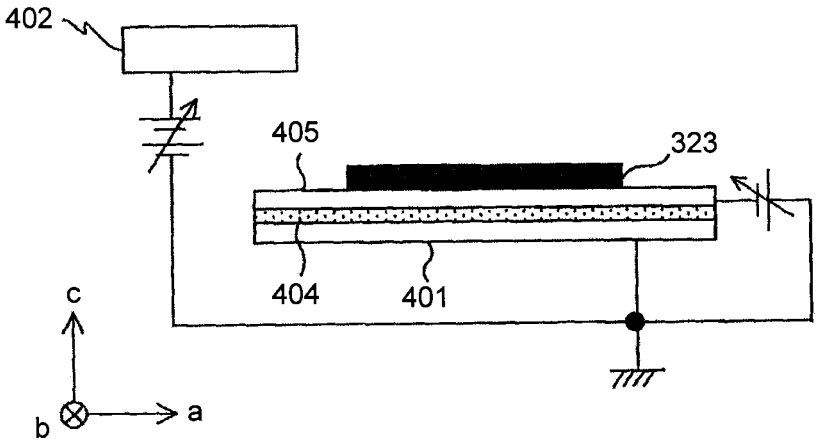
FIG. 23 is a diagram that illustrates a modified example of the electrostatic latent image measurement device.

As illustrated in FIG. 23, for example, an insulating member 404 and a conductive member 405 are provided between the specimen stage 401 and the specimen 323, and a voltage ±Vsub is applied to the conductive member 405. Furthermore, a conductive plate may be provided such that it is opposed to the detector 402.

Figure 24:
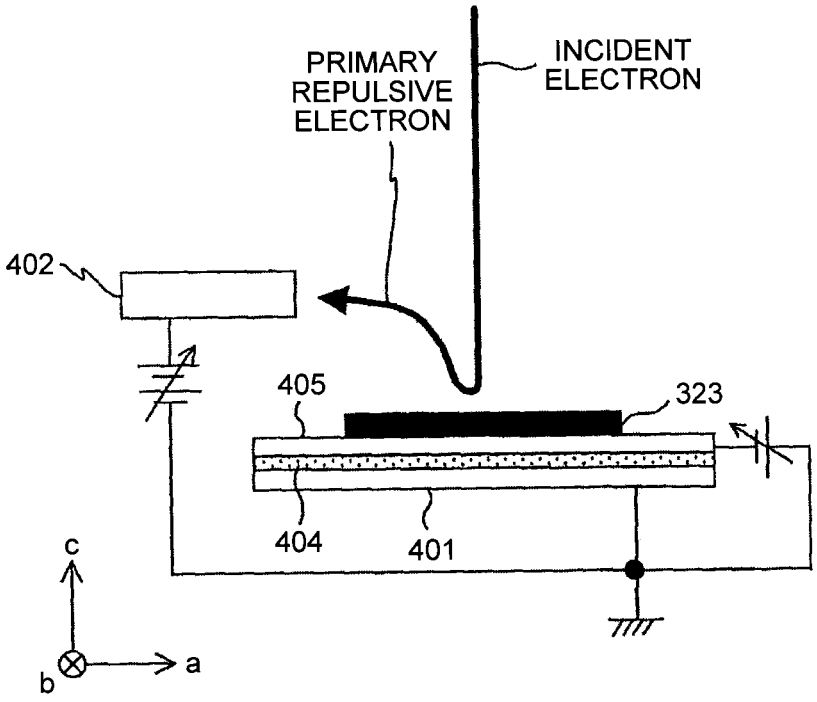
FIG. 24 is a diagram that illustrates an object that is detected by the electrostatic latent image measurement device according to the modified example.

The detector 402 detects a primary repulsive electron (see FIG. 24).

Although an acceleration voltage is usually represented as being positive, Vacc is negative and, in order to make it physically meaningful as an electric potential, it is easy to explain it if the acceleration voltage is represented as being negative; therefore, the acceleration voltage is here represented as being negative (Vacc<0). Furthermore, the electric potential of the specimen 323 is Vp (<0).

An electric potential is an electric potential energy per unit charge. Therefore, an incident electron moves at a velocity that corresponds to the acceleration voltage Vacc in the case where the electric potential is 0 (V). Specifically, when the amount of electric charge of an electron is e and the mass of the electron is m, the initial velocity $V_0$ of the electron is represented by $mv_0^2/2=e\times|Vacc|$. In a vacuum, in accordance with the law of conservation of energy, it is in a state of uniform motion at an area where the acceleration voltage is not applied, the electric potential thereof increases as it comes closer to the specimen 323, and the velocity thereof decreases while it is affected by the Coulomb's repulsion due to the electric charge of the specimen 323. Therefore, the following phenomena are generally caused.

Figure 25A:
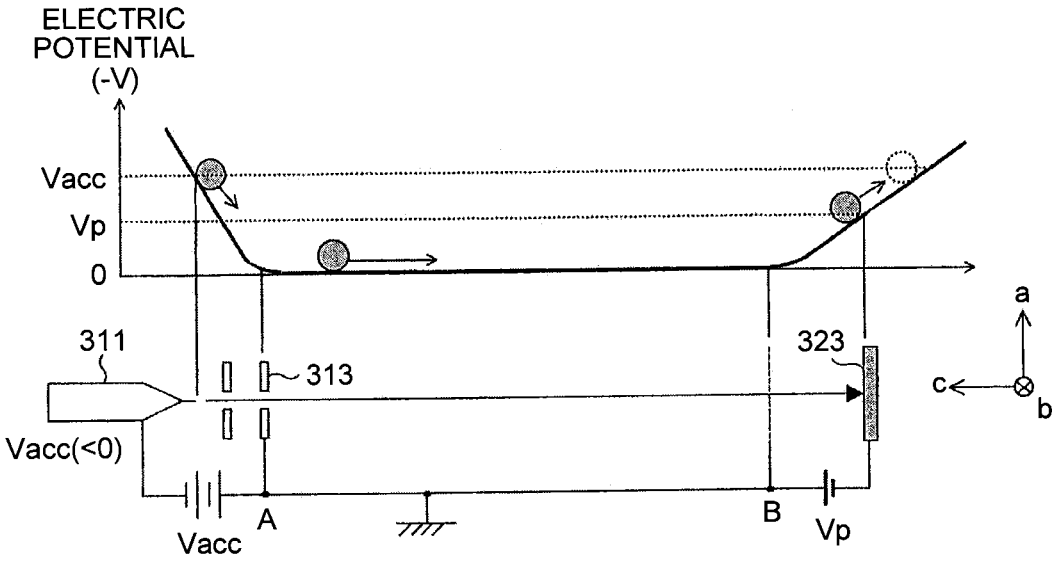
FIGS. 25A and 25B are diagrams that illustrate the behavior of an electron beam in the electrostatic latent image measurement device according to the modified example.
Figure 25B:
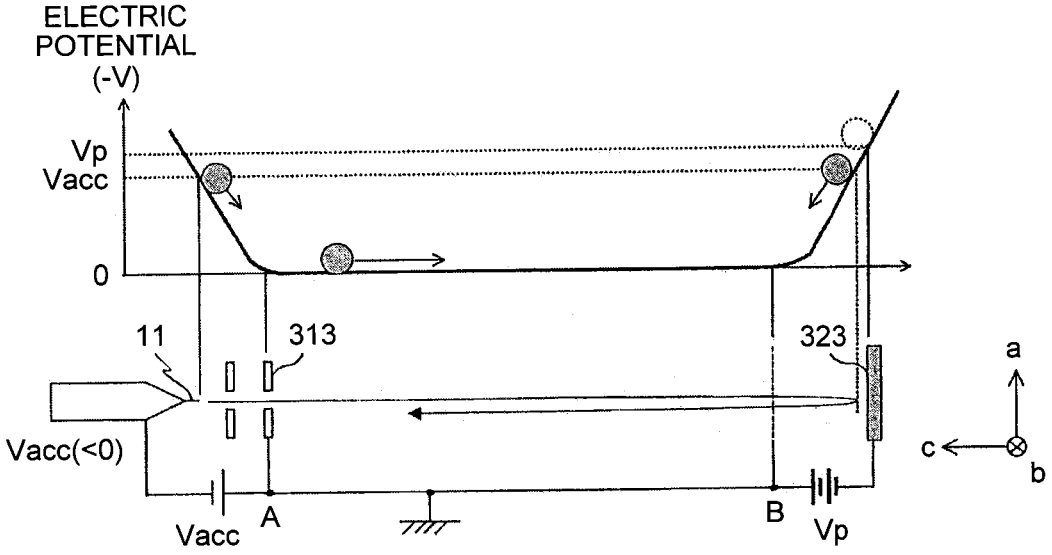

When |Vacc|≥|Vp|, an incident electron reaches the specimen 323 although its velocity decreases (see FIG. 25A). Conversely, when |Vacc|<|Vp|, the velocity of an incident electron gradually decreases due to an effect of the electric potential of the specimen 323, the velocity becomes zero before it reaches the specimen 323, and it moves in an opposite direction (see FIG. 25B).

In a vacuum where there is no air resistance, the law of conservation of energy almost holds good. Therefore, the electric potential on the surface of the specimen 323 can be measured by measuring a condition in which the energy, i.e., the landing energy, on the surface of the specimen 323 becomes nearly zero when the energy of the incident electron is changed. With regard to secondary electrons that are generated when incident electrons reach the specimen 323 and primary repulsive electrons, the number of secondary electrons that reach the detector 402 is significantly different from that of primary repulsive electrons; therefore, they can be determined by using the boundary of a light-dark contrast.

Incidentally, scanning electron microscopes, or the like, include reflected electron detector and, in this case, reflected electrons usually mean electrons that are ejected from the surface of a specimen as the incident electrons are reflected (scattered) by the rear surface due to a mutual effect with a material of the specimen. The energy of a reflected electron is equal to the energy of an incident electron. It is said that the velocity vector of a reflected electron is larger as the atomic number of a specimen is larger. Reflected electrons are used to detect the difference in the composition of a specimen, the concavity and convexity on a surface thereof, or the like. Conversely, primary repulsive electrons mean electrons that are affected by an electric potential distribution on the surface of a specimen and are reversed before reaching the surface of the specimen, and they are entirely different from reflected electrons.

Figures 26A, 26B, 26C:
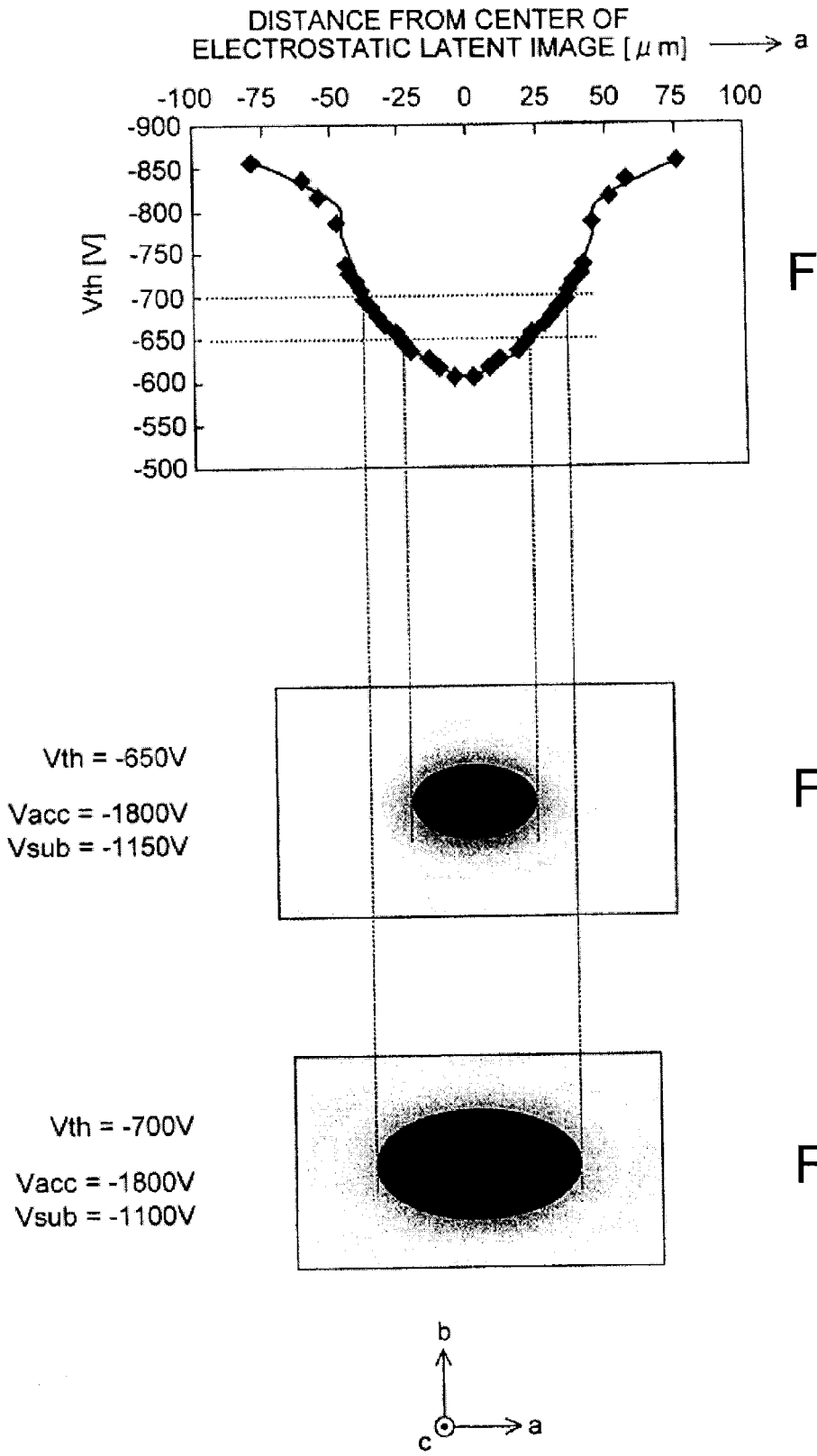
FIGS. 26A to 26C are diagrams that illustrate an example of a measurement result obtained by the electrostatic latent image measurement device according to the modified example.

FIGS. 26A to 26C illustrate an example of the result obtained by measuring an electrostatic latent image. Vth is the difference between Vacc and Vsub (=Vacc−Vsub). The electric potential distribution V(a, b) can be determined by using Vth(a, b) when the landing energy becomes nearly zero at each of the scanning locations (a, b). Vth(a, b) has a unique correspondence relationship with the electric potential distribution V(a, b) and, if the charge distribution is smooth, Vth(a, b) is approximately equivalent to the electric potential distribution V(a, b). In FIG. 26A, the curved line indicates the relation between Vth and the distance from the center of an electrostatic latent image, and it is an example of the surface potential distribution that is generated due to the charge distribution on the surface of the specimen.

Here, Vacc is −1800 V. The electric potential at the center of the electrostatic latent image is about −600 V, the electric potential increases negatively as the distance from the center increases, and the electric potential in a peripheral area away from the center by more than 75 μm is about −850 V.

FIG. 26B is a diagram of an image that is obtained from an output of the detector 402 when a setting is made such that Vsub=−1150 V. Here, Vth=−650 V. FIG. 26C is a diagram of an image that is obtained from an output of the detector 402 when a setting is made such that Vsub=−1100 V. Here, Vth=−700 V.

Here, while Vacc or Vsub is changed, the surface of the specimen is scanned with an electron beam, and Vth(a, b) is measured, whereby the surface potential information on the specimen can be obtained. By using this method, it is possible to obtain the profile of an electrostatic latent image as a visible image in the order of microns, which is conventionally difficult.

In a method for obtaining the profile of an electrostatic latent image by detecting primary repulsive electrons, as the energy of an incident electron is extremely changed, the track of an incident electron deviates and, as a result, a change in the scanning magnification or distortion sometimes occurs. Therefore, in such a case, the circumstance of a static electric field or the track of an electron is calculated in advance and, a detection result is corrected in accordance with the result of a calculation; thus, the profile of the electrostatic latent image can be obtained with a higher accuracy.

Specifically, by using the electrostatic latent image measurement device 300, it is possible to obtain, with a higher accuracy, the charge distribution of an electrostatic latent image, the surface potential distribution, the electric-field intensity distribution, and the electric field intensity with respect to a direction perpendicular to the surface of a specimen.

In recent years, there has been an increasing demand for higher image quality and higher stabilization during an electrophotographic process. Especially, there is a requirement for an output image where it is possible to perceive a character of a microscopic size that corresponds to two points or three points in 1200 dpi, i.e., white-on black two-points inverted character or three-points inverted character. However, it is difficult to output high-quality images and, although it is conventionally considered that its major cause is degradation during a developing process, transfer process, and fixing process, the effort to improve the developing process, transfer process, and fixing process has not led to the desired effect.

Even if a white-on-black inverted image is output by using the image pattern without change, the latent-image electric field vector in the vertical direction of a specimen is not inverted with respect to the one that occurs in the normal image, and the latent-image electric field vector in the vertical direction of the specimen is smaller in the case of the inverted image. The latent image does not match the image pattern signal supplied from the printer control device 1060. That is, it means that no matter how the developing process, transfer process, and fixing process are improved, it is difficult to expect the effect for high-quality images.

It is understood that, in order to print, especially, a white-on-black inverted character image with a higher image quality, it is effective to increase the latent-image electric field vector in the vertical direction of a specimen so as to prevent toner adhesion. In terms of electromagnetics, the simplest way to increase the electric field vector of a white area is to increase the amount of charge of a white image area; however, it is difficult to locally increase the amount of charge. Therefore, by using a devised light output pattern, it is possible to produce the same effect as that obtained when the amount of charge of a white image area is actually increased without performing an operation to change the light output pattern of the white image area so as to make it apparent.

Another problem is that, after, especially, an image processing unit is passed through, only the white and black image pattern information exists, and information on an inverted character, or the like, is eliminated. Therefore, an edge detection process, or the like, to recognize the character area is complicated, and false recognition easily occurs. Therefore, it is desirable to perform a simple and integrated operation without performing a special operation, such as edge detection or character information recognition, and without involving the image information on an inverted character, or the like.

A several conventional inventions are given below; however, each of the inventions uses a different image processing method and does not have a technical idea of increasing the latent-image electric field vector in the vertical direction of a specimen.

The invention disclosed in Japanese Patent Application Laid-open No. 09-247477 solves the problem of the electric field bending, i.e., the edge electric field, and has a different technical idea from that of the present application, i.e., changing the white pixel of interest itself. Furthermore, it does not mention the latent-image electric field.

With respect to the invention disclosed in Japanese Patent Application Laid-open No. 09-085982, the normal character image is assumed and an inverted image is not mentioned.

The invention disclosed in Japanese Patent Application Laid-open No. 2004-181868 uses an entirely different image processing method and does not have the technical idea of increasing the latent-image electric field vector in the vertical direction of a specimen. It is a technology used under a developing condition that includes error factors, such as toner, carrier, or a developing unit, and no measurement unit is provided; therefore, it is difficult to expect essential improvements.

The object of the present invention is that, as it is determined that the cause of image degradation is generated at the step of obtaining a latent image before developing it, the cause is solved at the step of obtaining the electrostatic latent image before transferring it to the next step, and thus it is possible to achieve a higher image quality and stabilization of a microscopic character image, i.e., a white-on-black inverted character image, which is conventionally insufficient.

By using a unit that increases the latent-image electric field vector in the vertical direction of a specimen so as to prevent toner adhesion, a character image of a microscopic size, i.e., a white-on-black inverted character image, is output with a higher image quality. Furthermore, it is possible to provide an electrostatic latent image forming apparatus that can be used for any images and that uses a simple rule without performing a special operation, such as edge detection or character information recognition.

Thus, it is possible to form a microscopic electrostatic latent image without reducing the size of an optical spot, and it is suitable for an optical scanning apparatus that has difficulty generating an optical spot of a microscopic size and, especially, is suitable for an image forming apparatus that has a high resolution with respect to a microscopic character or white-on-black inverted character.

Figure 27:
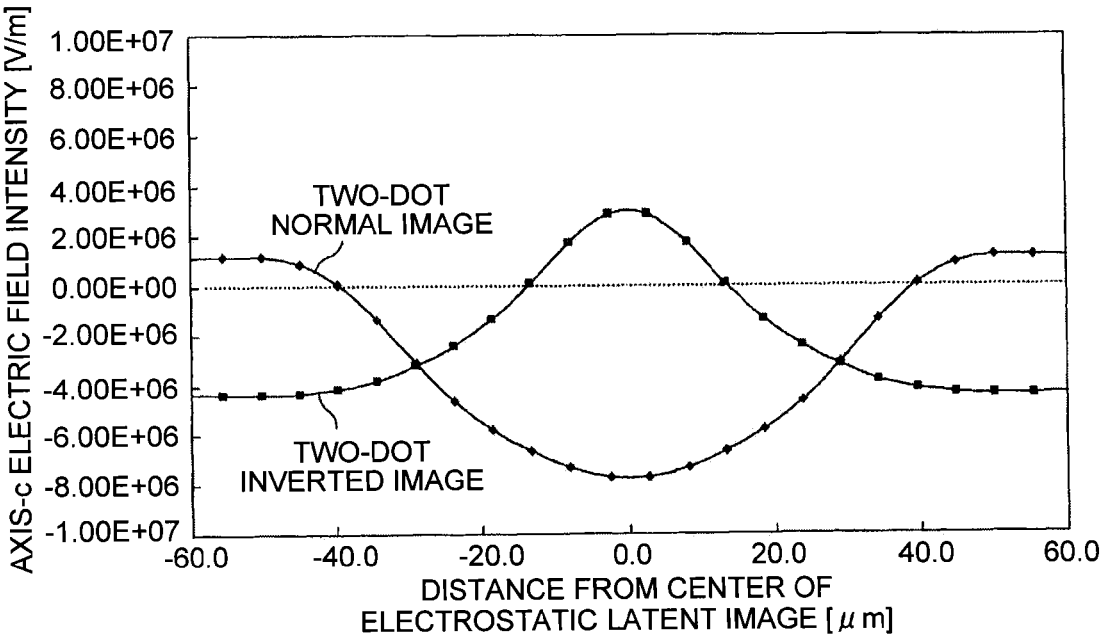
FIG. 27 is a diagram that illustrates the intensity distribution of the axis-c electric field intensity of electrostatic latent images of a two-dot normal image and a two-dot inverted image.
Figure 28A:
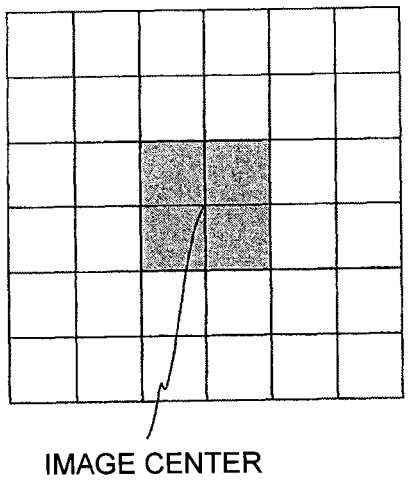
FIG. 28A is a diagram that illustrates a two-dot normal image.
Figure 28B:
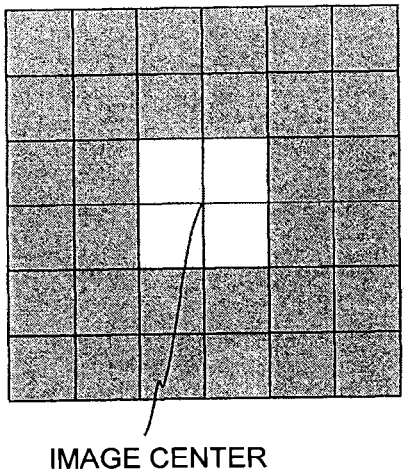
FIG. 28B is a diagram that illustrates a two-dot inverted image.

FIG. 27 illustrates the relation between the electric field intensity of an electrostatic latent image (hereafter, simply referred to as the "axis-c electric field intensity" for convenience) in a direction (here, the direction of the axis c) perpendicular to the surface of a specimen and the distance from the center of the electrostatic latent image when an electrostatic latent image is formed with respect to a two-dot normal image (see FIG. 28A) and a two-dot inverted image (see FIG. 28B) according to an image pattern, i.e., Ib+Iop is supplied to the light source when a black dot is formed and only Ib is supplied to the light source when a white dot is formed. The center of an electrostatic latent image refers to a location in the electrostatic latent image that corresponds to the center of the image.

A photosensitive element of a specimen is azo-based, and its film thickness is 30 μm. Furthermore, the charged voltage is 500 V, the wavelength of laser light during exposure is 655 nm, and the resolution is 1200 dpi. Moreover, a white dot is not irradiated with light, and a black dot is irradiated with an amount of light of 100% and a duty of 100%.

The axis-c electric field intensity of the two-dot inverted image is extremely lower than that of the two-dot normal image. Thus, a large electrostatic latent image is formed on the two-dot normal image due to exposure and it is determined that, even if the two-dot normal image is inverted, the axis-c electric field intensity is not inverted. That is, with the two-dot inverted image, it is difficult to obtain a desired output image. It is conventionally considered that it is difficult to obtain a desired output image due to a developing process, transfer process, and fixing process; however, as an electrostatic latent image on a photosensitive element is able to be measured, the fact first comes out that a failure has already occurred at the step of forming an electrostatic latent image.

Therefore, in the present embodiment, with regard to each white dot, attention is focused on the number of black dots that are adjacent to the white dot. A black dot that is adjacent to a white dot means the black dot that is adjacent to the white dot on any of the +a side, the −a side, the +b side, and the −b side.

Figure 29A:
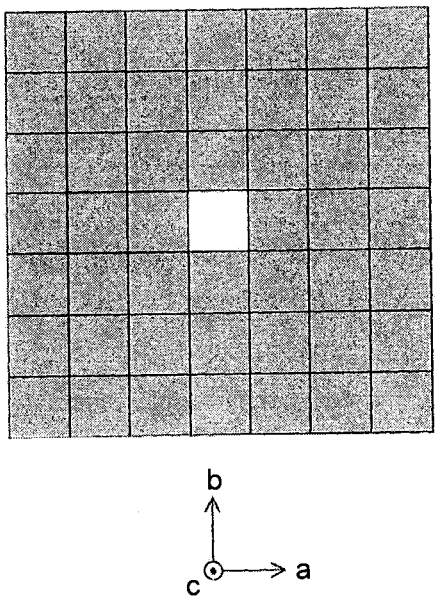
FIGS. 29A and 29B are diagrams (1) that illustrate the flags that are attached to the black dots that are adjacent to a white dot.
Figure 29B:
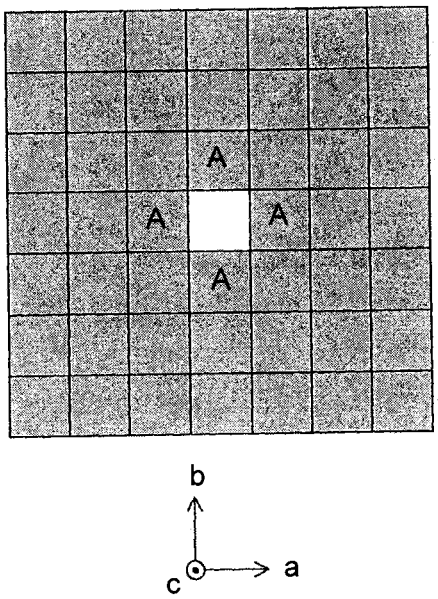

As illustrated in FIG. 29A, for example, if the number of black dots that are adjacent to the white dot is four, flag A is attached to the adjacent black dots (see FIG. 29B).

Figure 30A:
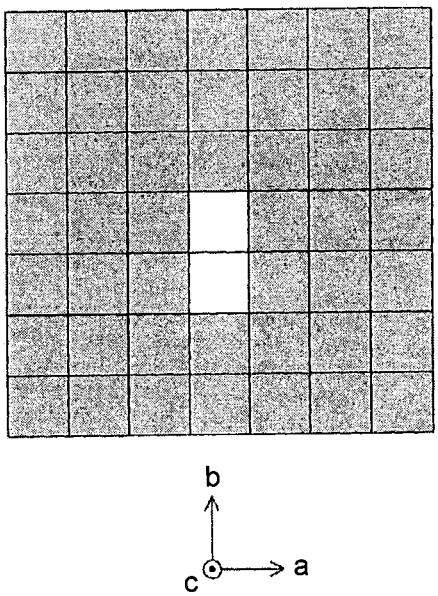
FIGS. 30A and 30B are diagrams (2) that illustrate the flags that are attached to the black dots that are adjacent to a white dot.
Figure 30B:
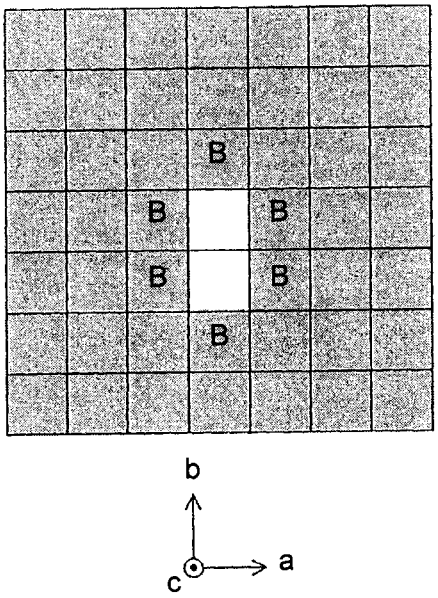

Furthermore, as illustrated in FIG. 30A, for example, if the number of black dots that are adjacent to the white dot is three, flag B is attached to the adjacent black dots (see FIG. 30B).

Figure 31A:
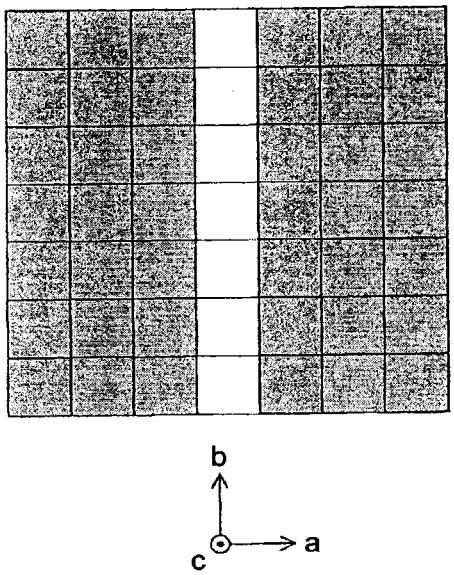
FIGS. 31A and 31B are diagrams (3) that illustrate the flags that are attached to the black dots that are adjacent to a white dot.
Figure 31B:
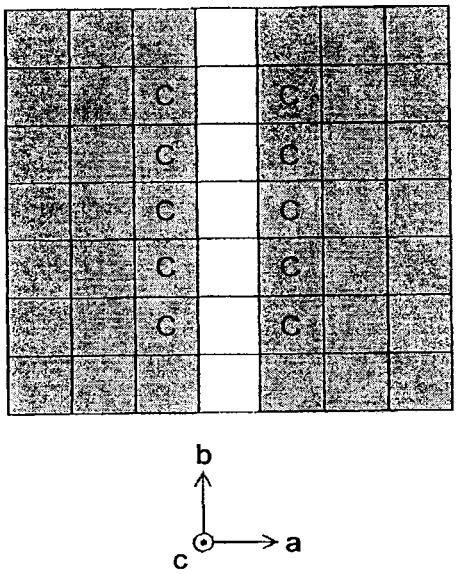

Furthermore, as illustrated in FIG. 31A, for example, if the number of black dots that are adjacent to the white dot is two, flag C is attached to the adjacent black dots (see FIG. 31B). As the number of adjacent black dots is not certain with respect to the white dot at the end, it is ignored here.

Figure 32A:
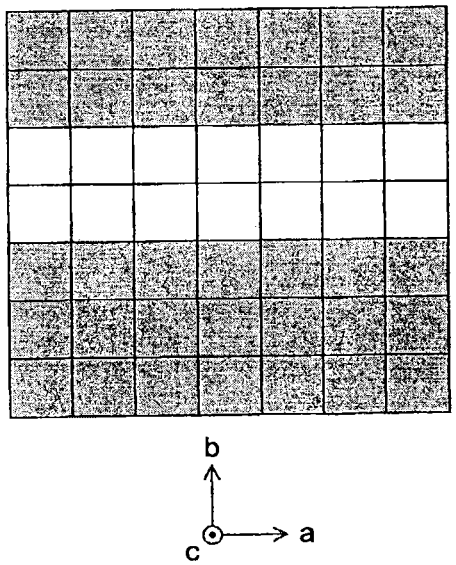
FIGS. 32A and 32B are diagrams (4) that illustrate the flags that are attached to the black dots that are adjacent to a white dot.
Figure 32B:
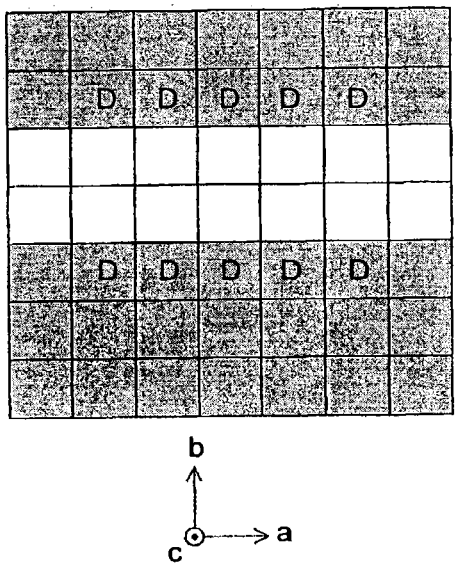

Furthermore, as illustrated in FIG. 32A, for example, if the number of black dots that are adjacent to the white dot is one, flag D is attached to the adjacent black dot (see. FIG. 32B).

Figure 33A:
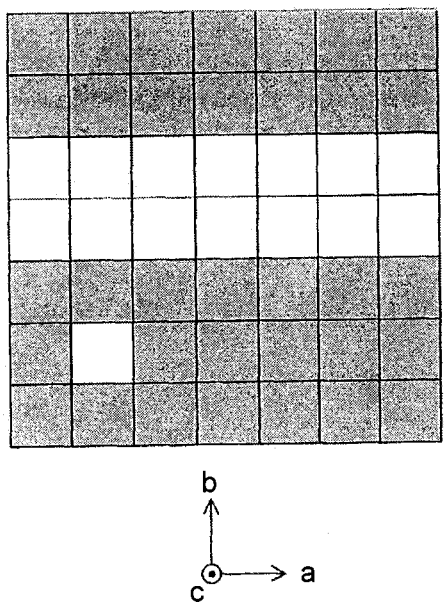
FIGS. 33A to 33C are diagrams that illustrate the flag that is attached to a single black dot when it is adjacent to two white dots.
Figure 33B:
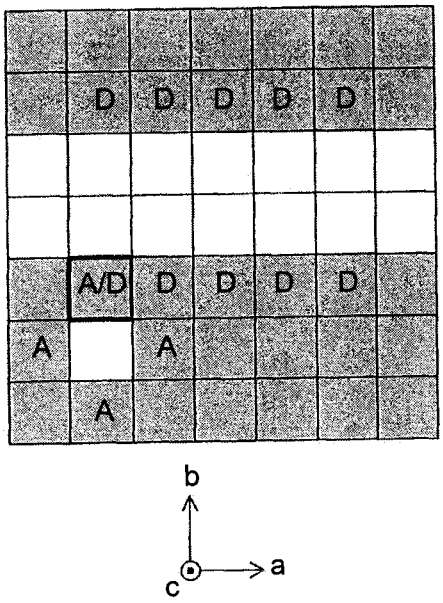
Figure 33C:
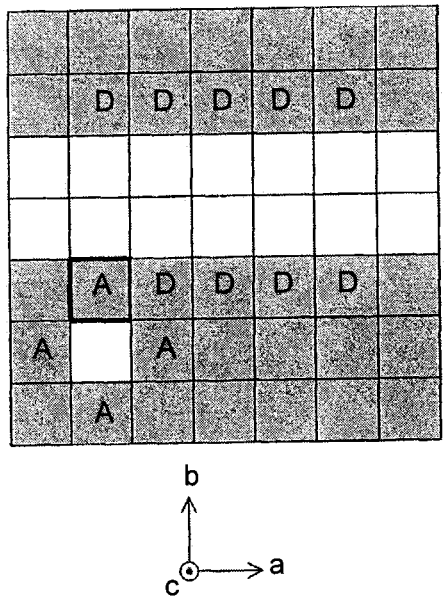

As illustrated in FIG. 33A, if a single black dot is adjacent to two white dots, the flag D is set to the black dot with regard to one of the white dots and the flag A is set to the black dot with regard to the other one of the white dots (see FIG. 33B). As described above, if multiple different flags are possible, priority is given to the white dot that has a larger number of adjacent black dots, and the flag A is set to the black dot (see FIG. 33C).

Figure 34A:
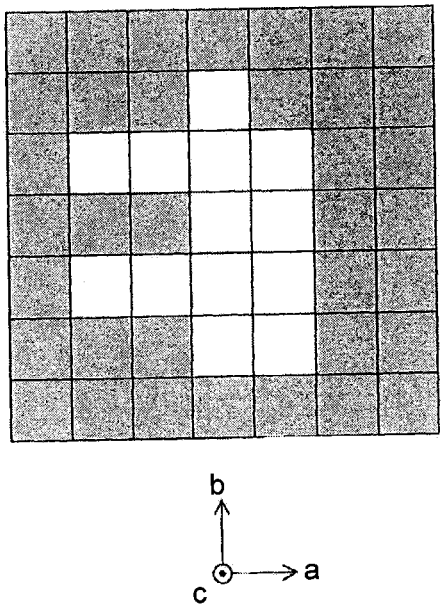
FIGS. 34A to 34C are diagrams that illustrate the flag that is attached to a single black dot when it is adjacent to three white dots.
Figure 34B:
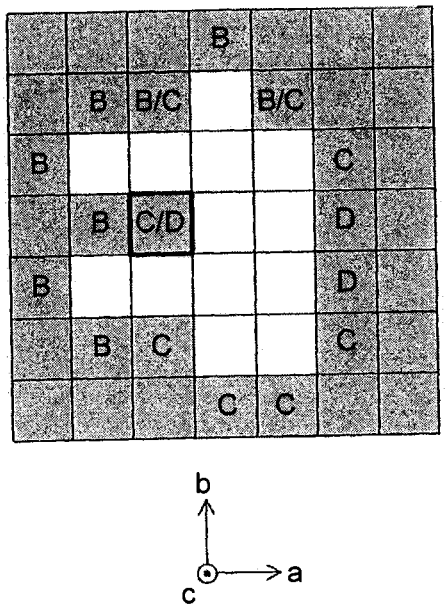
Figure 34C:
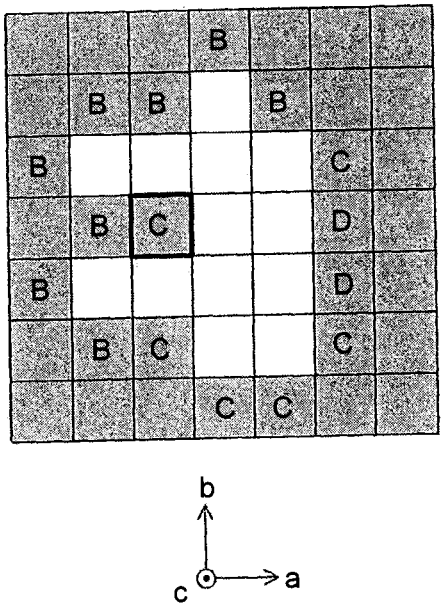

Furthermore, FIG. 34A illustrates a case where a single black dot is adjacent to three white dots. In this case, the flags C and D are possible for the black dot; however, priority is given to the white dot that has a larger number of adjacent black dots, and the flag C is set to the black dot (see FIG. 34C).

That is, attention is focused on the black dot that is adjacent to a white dot, the number of black dots that are adjacent to the white dot is counted, and the largest number (referred to as the BM number) is extracted.

Figure 35:
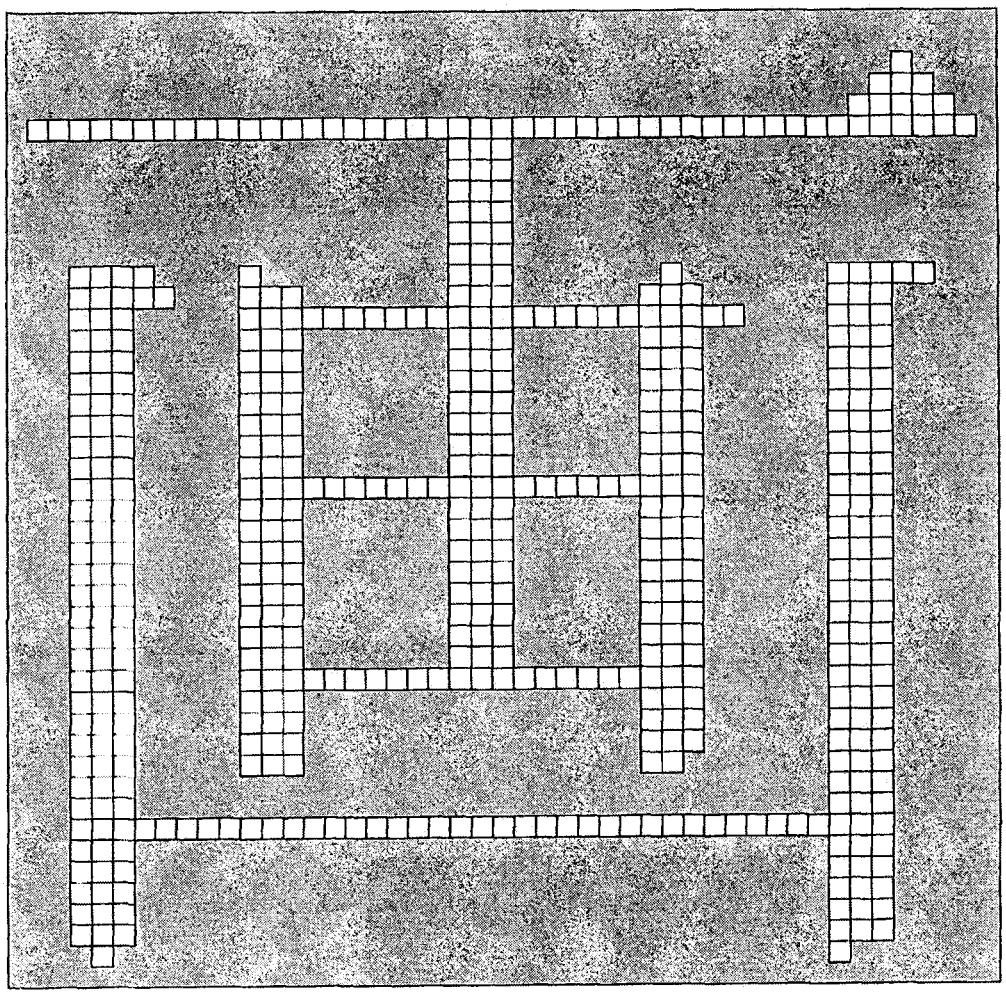
FIG. 35 is a diagram that illustrates an inverted image of "画"
Figure 35:
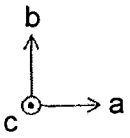
Figure 36:
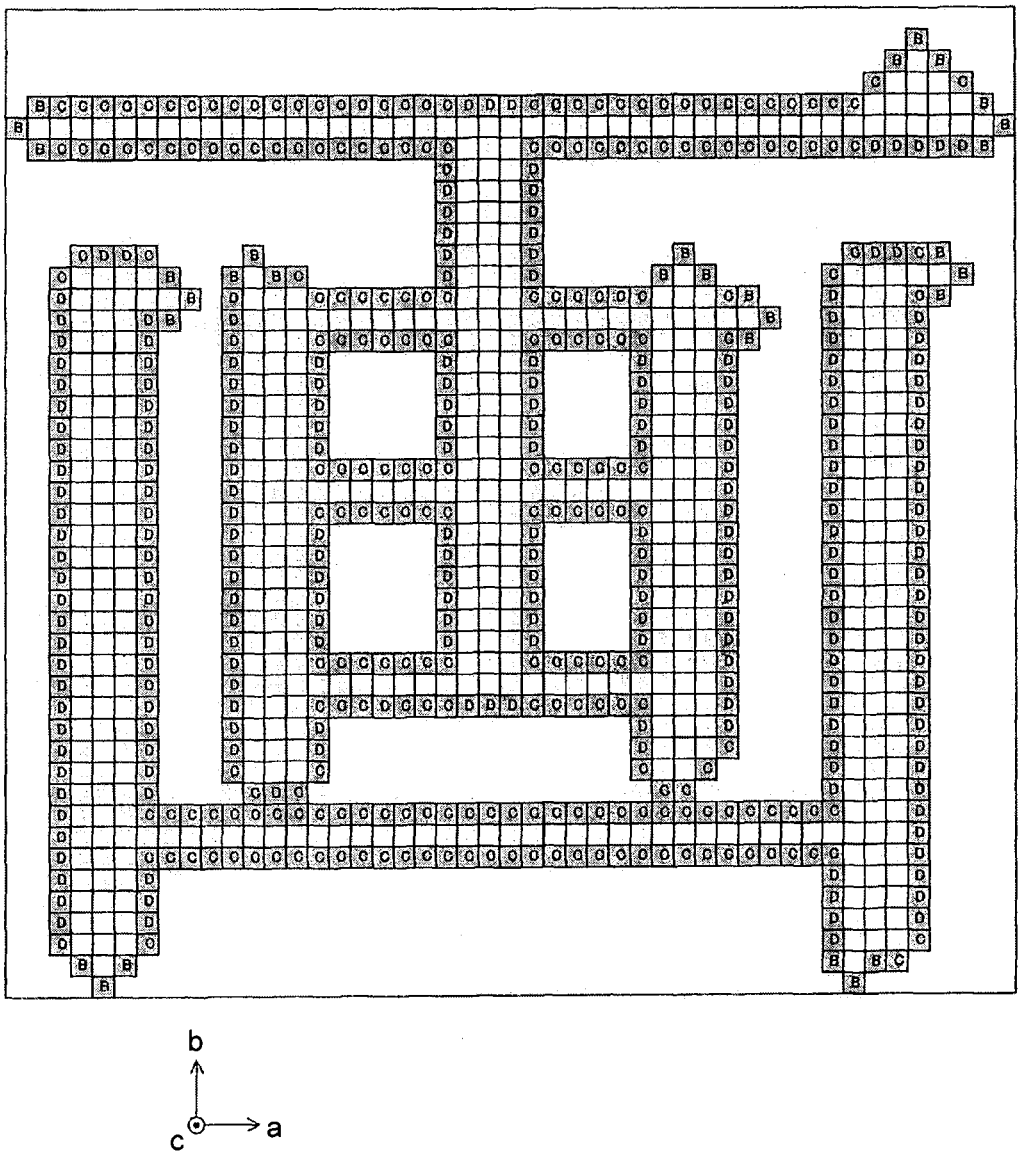
FIG. 36 is a diagram that illustrates the flags that are attached to the black dots that are adjacent to a white dot in the inverted image of "画"
Figure 37:
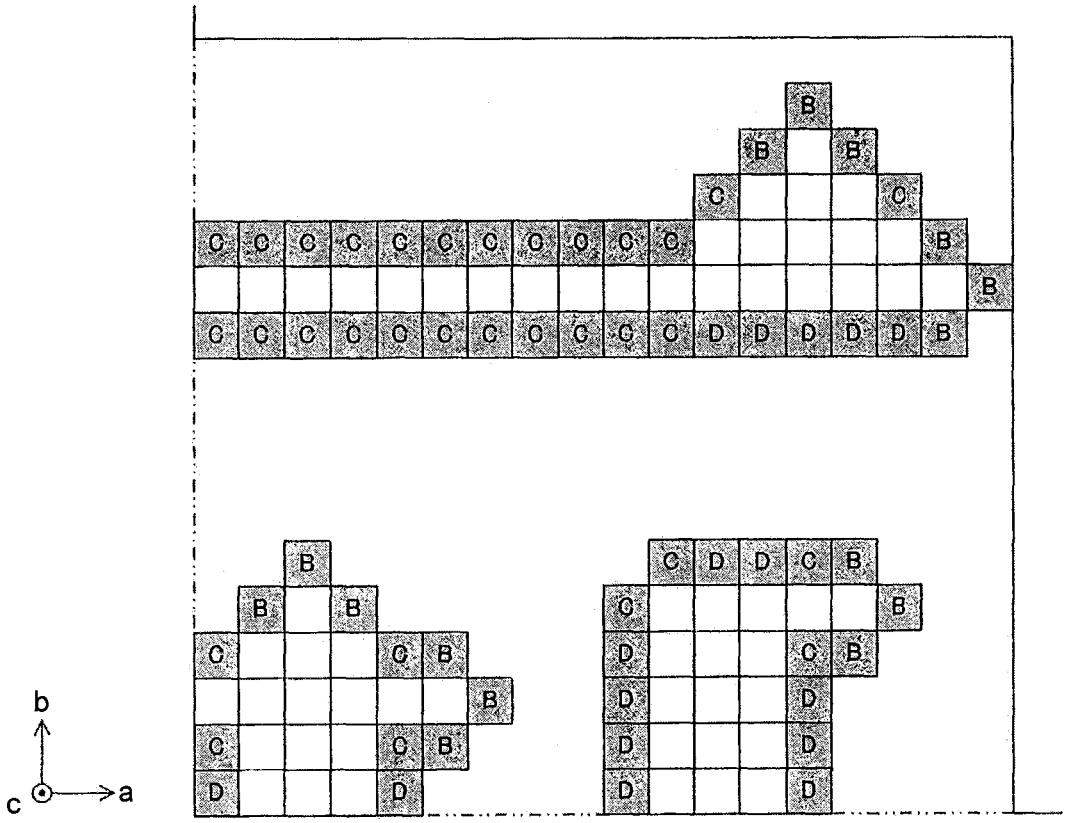
FIG. 37 is a partial enlarged diagram of FIG. 36.
Figure 38:
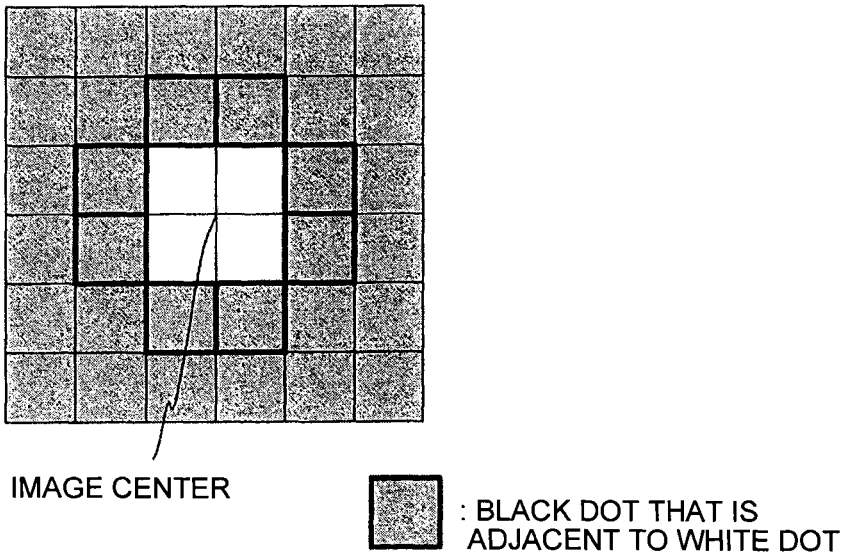
FIG. 38 is a diagram that illustrates the black dots that are adjacent to a white dot in a two-dot inverted image.

FIG. 35 illustrates an inverted image of "画", and FIG. 36 illustrates the flags of the black dots that are adjacent to each white dot in the inverted image. Furthermore, FIG. 37 illustrates part of FIG. 36 in an enlarged manner.

Next, the two-dot inverted image is formed while the exposure condition for only the black dot (see FIG. 38) that is adjacent to the white dot is changed, and the relation between the axis-c electric field intensity and the distance from the center of the electrostatic latent image is determined. An amount of light of 100% and a duty of 100% are set as default. In this case, the center of the electrostatic latent image corresponds to the boundary between two white dots. That is, the vicinity of the center of the electrostatic latent image corresponds to a white dot.

A. Exposure Condition 1 (PWM)

Figure 39:
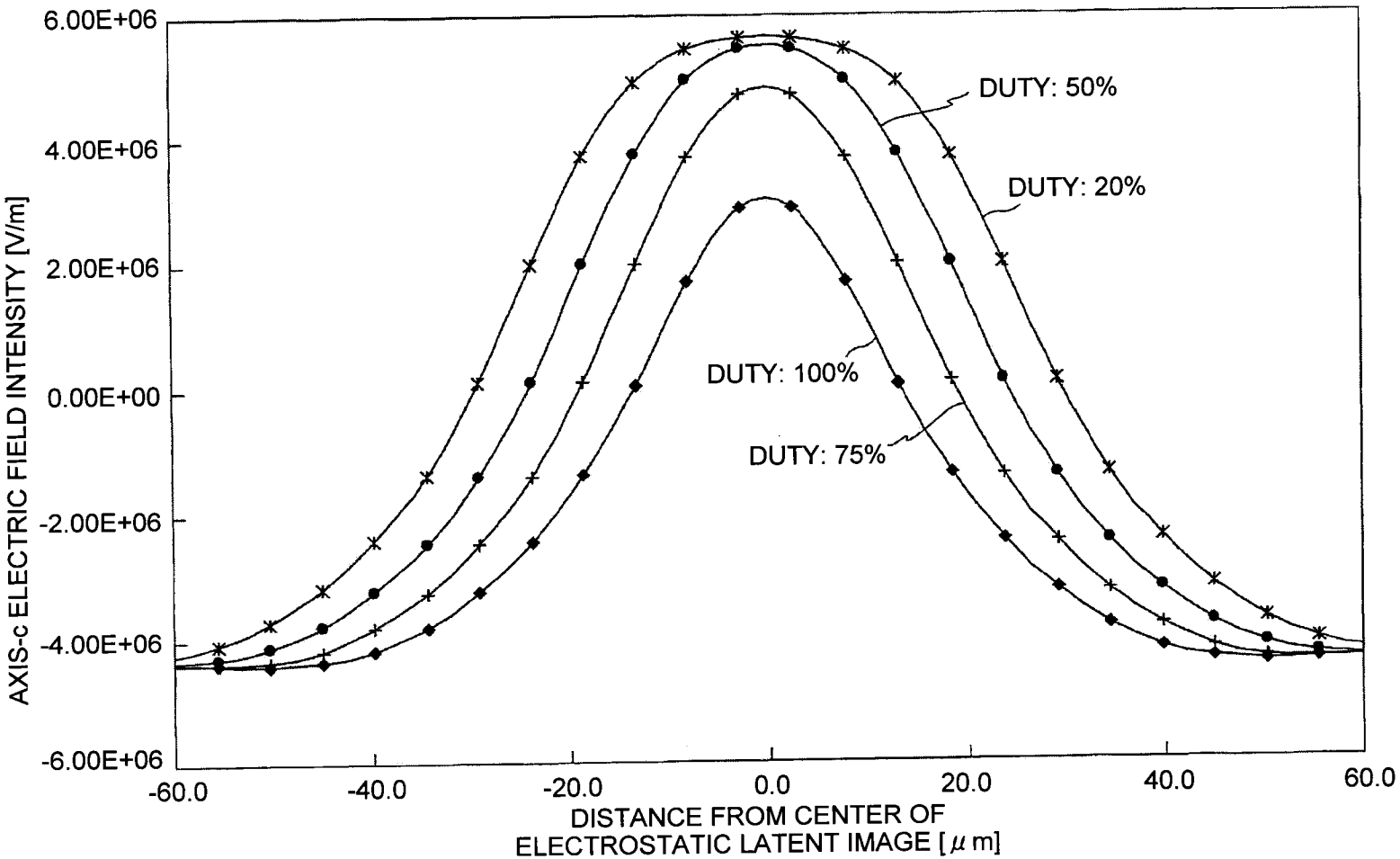
FIG. 39 is a diagram that illustrates the relation between the duty and the axis-c electric field intensity of an electrostatic latent image of a two-dot inverted image.
Figure 40:
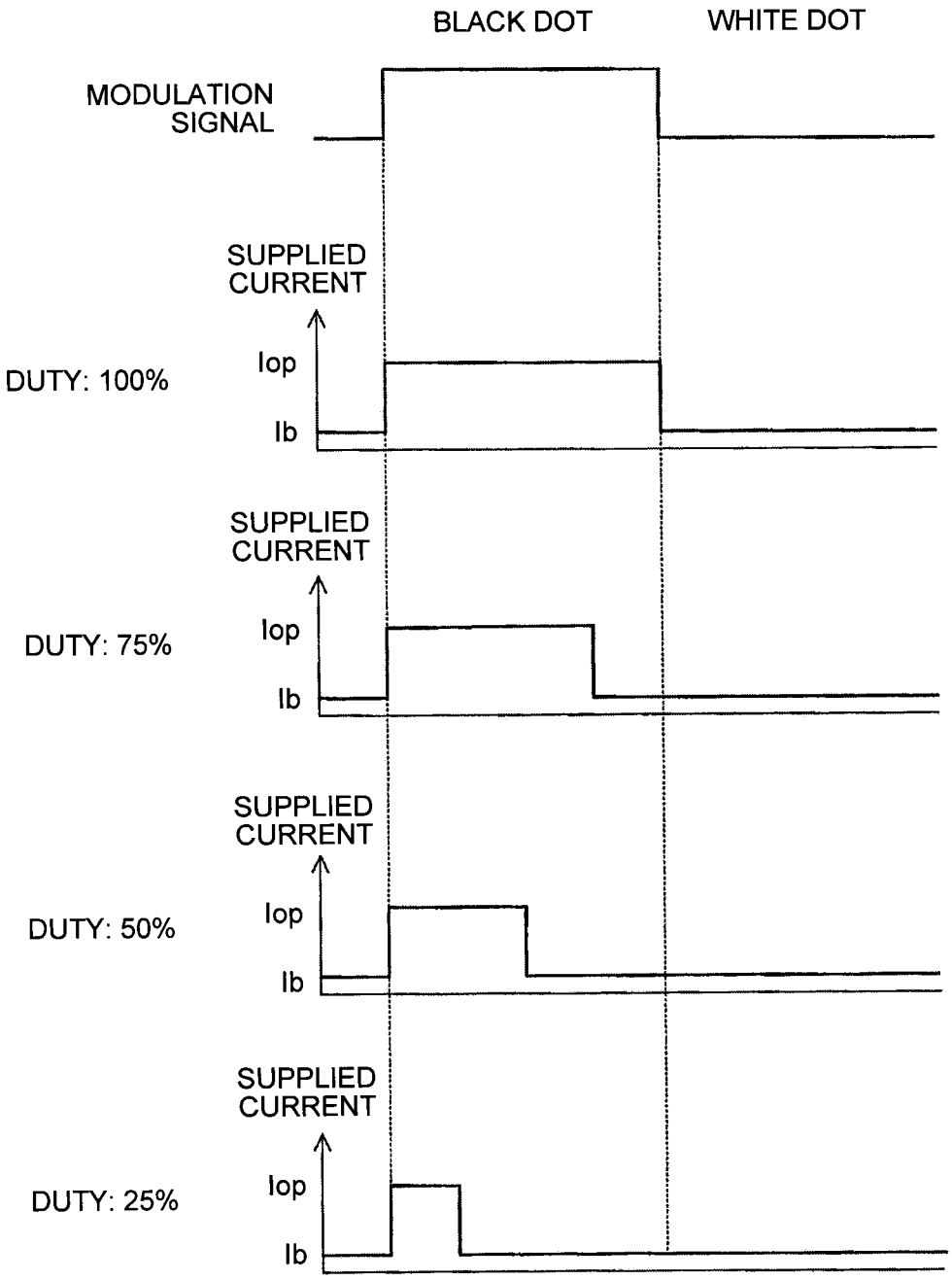
FIG. 40 is a diagram that illustrates the duty: 100%, the duty: 75%, the duty: 50%, and the duty: 25% in FIG. 39.

FIG. 39 illustrates the relation between the axis-c electric field intensity and the distance from the center of an electrostatic latent image of a two-dot inverted image when the electrostatic latent image is formed while only the duty is changed to 75%, 50%, and 25% relative to the default, as illustrated in FIG. 40, as one of the exposure conditions for the black dot that is adjacent to the white dot. According to the exposure condition where the duty is lower than 100%, a setting is made such that lighting for a black dot is performed at timing separate from that for a white dot.

The axis-c electric field intensity at the center of an electrostatic latent image is $2.88\times10^6$ V/m as default, $4.73\times10^6$ V/m when the duty is 75%, $5.47\times10^6$ V/m when the duty is 50%, and $5.65\times10^6$ V/m when the duty is 25%.

Here, the exposure condition is changed for only the black dot that is adjacent to the white dot, and it is not changed at all for the white dot; nevertheless, the axis-c electric field intensity of the white dot is changed. Furthermore, as the duty is decreased, the axis-c electric field intensity of the white dot is increased, and toner is less likely to be attached.

For example, the duty is set to 25% for a black dot that has the flag A, the duty is set to 50% for a black dot that has the flag B, the duty is set to 75% for a black dot that has the flag C, and the duty is set to 100% for a black dot that has the flag D; thus, it is possible to obtain an output image where white dots are represented more clearly, compared to a conventional case.

In this case, the relation of EA≥EB≥EC≥ED is established between the axis-c electric field intensity (referred to as "EA") of a white dot that is adjacent to a black dot that has the flag A, the axis-c electric field intensity (referred to as "EB") of a white dot that is adjacent to a black dot that has the flag B, the axis-c electric field intensity (referred to as "EC") of a white dot that is adjacent to a black dot that has the flag C, the axis-c electric field intensity (referred to as "ED") of a white dot that is adjacent to a black dot that has the flag D.

Moreover, the duty may be set to 0% (no lighting) for a black dot that has the flag A, the duty may be set to 25% for a black dot that has the flag B, the duty may be set to 50% for a black dot that has the flag C, and the duty may be set to 75% for a black dot that has the flag D. In this case, the relation of EA≥EB≥EC≥ED is also established, and it is possible to obtain an output image where white dots are represented more clearly, compared to a conventional case.

The set value of the duty may be a fixed value; however, as the appropriate set value of the duty is different depending on an apparatus, it is preferable that an appropriate value is determined in accordance with an actual apparatus by performing an experiment in advance, or the like.

B. Exposure Condition 2 (PM)

Figure 41:
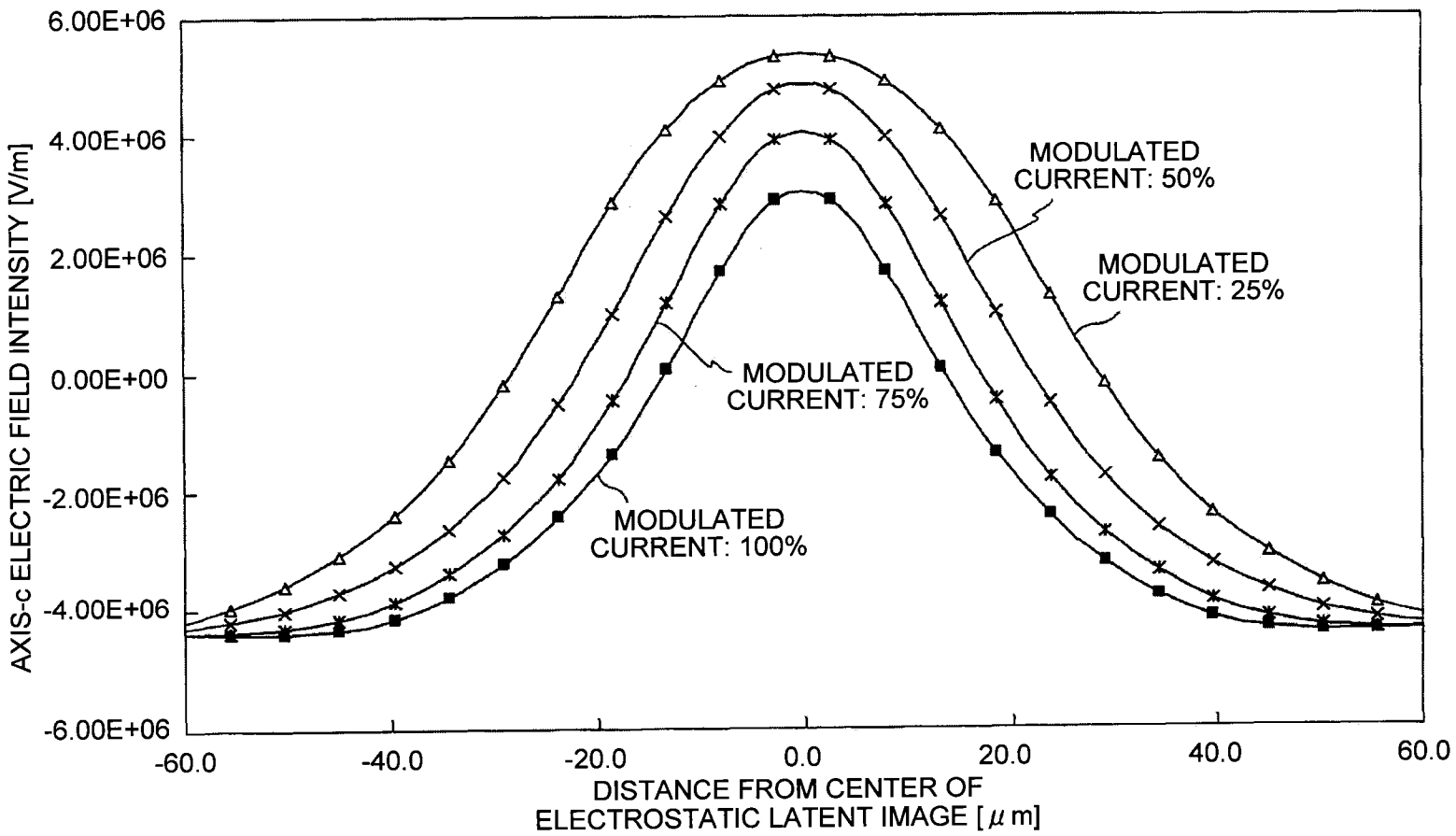
FIG. 41 is a diagram that illustrates the relation between the modulated current and the axis-c electric field intensity of an electrostatic latent image of a two-dot inverted image.
Figure 42:
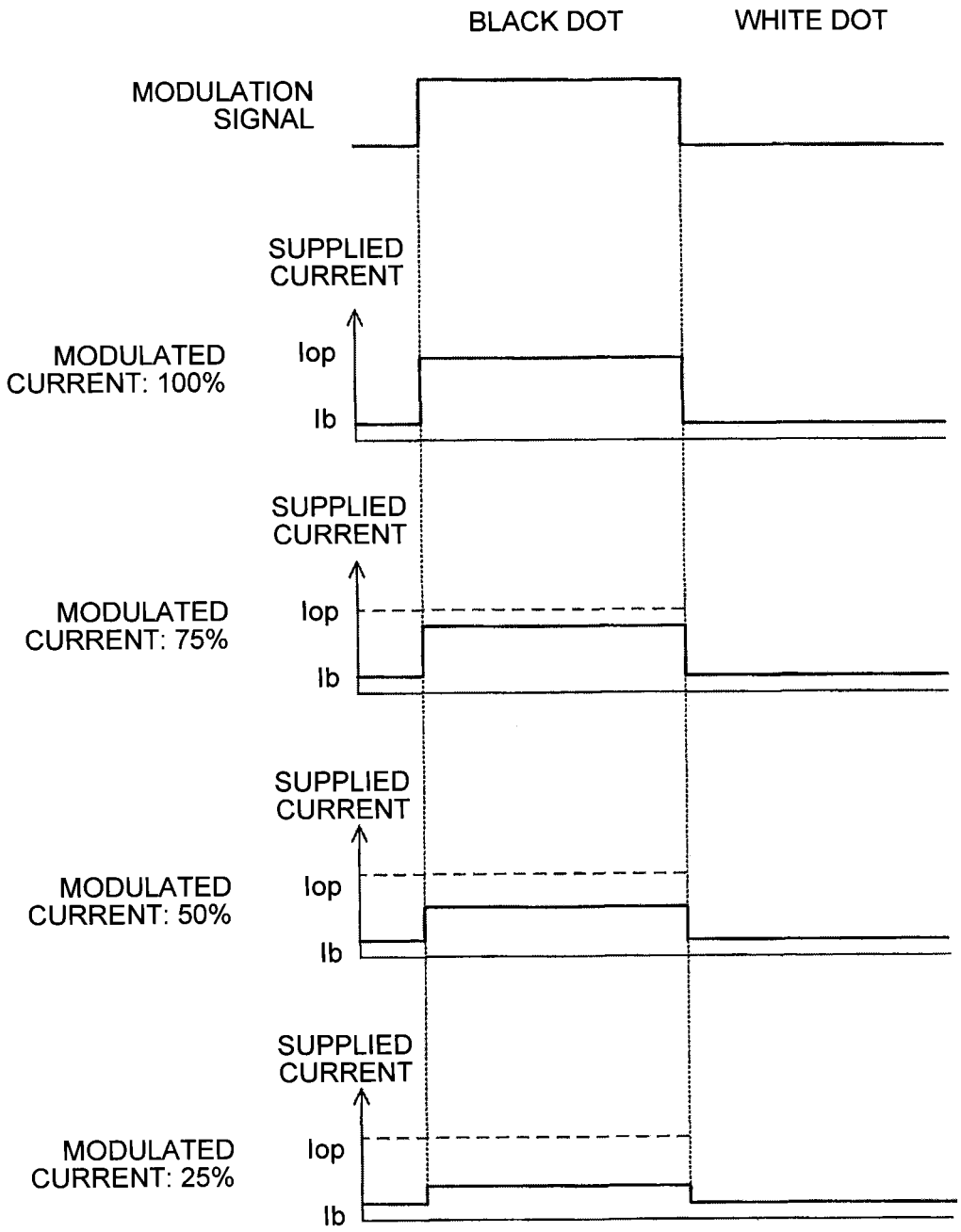
FIG. 42 is a diagram that illustrates the modulated current: 100%, the modulated current: 75%, the modulated current: 50%, and the modulated current: 25% in FIG. 41.

FIG. 41 illustrates the relation between the axis-c electric field intensity and the distance from the center of an electrostatic latent image of a two-dot inverted image when the electrostatic latent image is formed while only a modulated current is changed to 75%, 50%, and 25% relative to the default, as illustrated in FIG. 42, as one of the exposure conditions for the black dot that is adjacent to the white dot.

In this case, the exposure condition is also changed for only the black dot that is adjacent to the white dot, and it is not changed at all for the white dot; nevertheless, the axis-c electric field intensity of the white dot is changed. Furthermore, as the modulated current Iop is decreased, the axis-c electric field intensity of the white dot is increased, and toner is less likely to be attached.

For example, the modulated current is set to 25% for a black dot that has the flag A, the modulated current is set to 40% for a black dot that has the flag B, the modulated current is set to 60% for a black dot that has the flag C, and the modulated current is set to 80% for a black dot that has the flag D; thus, it is possible to obtain an output image where white dots are represented more clearly, compared to a conventional case. In this case, the relation of EA≥EB≥EC≥ED is also established.

The set value of the modulated current Iop may be a fixed value; however, as the appropriate set value of the modulated current Iop is different depending on an apparatus, it is preferable that an appropriate value is determined in accordance with an actual apparatus by performing an experiment in advance, or the like.

C. Exposure Condition 3 (PM+PWM)

Figure 43:
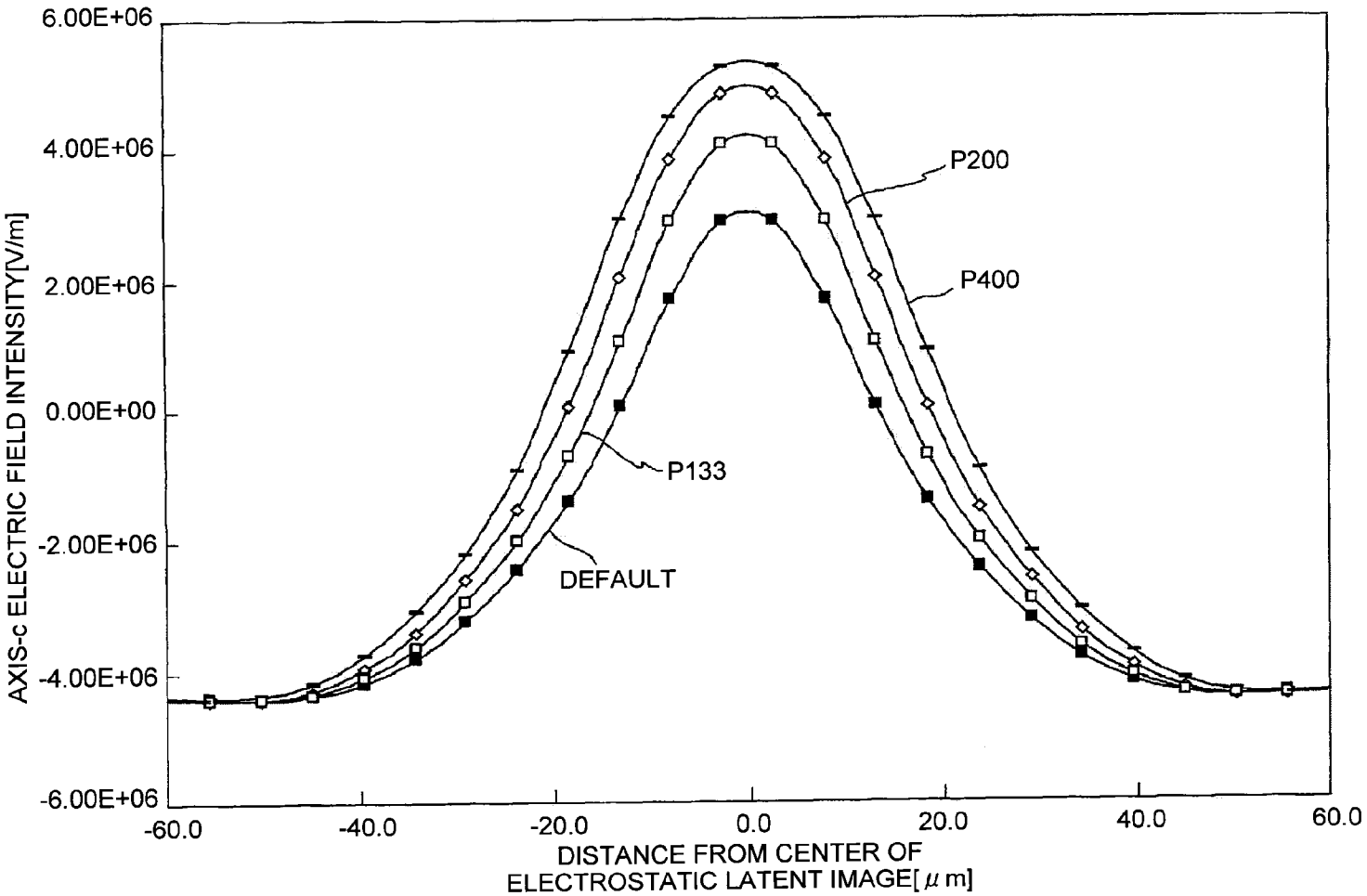
FIG. 43 is a diagram that illustrates the relation between the light output waveform and the axis-c electric field intensity of an electrostatic latent image of a two-dot inverted image.
Figure 44:
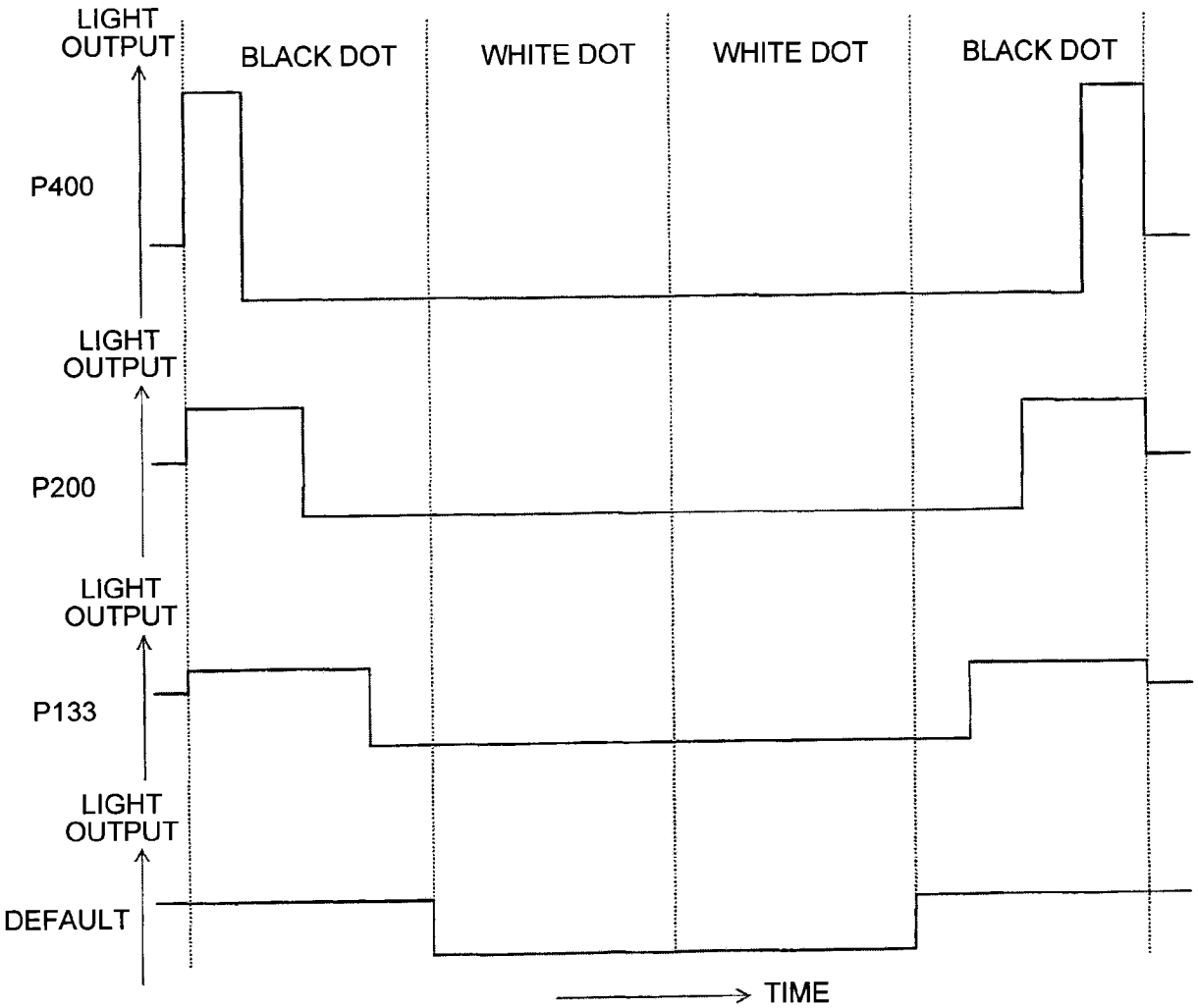
FIG. 44 is a diagram that illustrates P400, P200, P133, and the default in FIG. 43.

FIG. 43 illustrates the relation between the axis-c electric field intensity and the distance from the center of an electrostatic latent image of a two-dot inverted image when the electrostatic latent image is formed while the lighting time is shortened, the integrated amount of light is kept constant, and the light output is changed, as illustrated in FIG. 44, as one of the exposure conditions for the black dot that is adjacent to the white dot. Here, with respect to the normal exposure (default), the maximum light output is set to 400% for P400, 200% for P200, and 133% for P133. That is, an exposure is made by using a light output that is larger than the light output (default) that is used for a normal solid black image.

In this case, an exposure is made by using a high light output in a short lighting time, i.e., intensively in terms of time; thus, the following advantages are produced: (1) it is possible to raise/increase the latent-image electric field of a white-on-black image area, (2) the latent-image resolving power is improved, and (3) the black-pixel density can be maintained. Furthermore, it is a major feature that, as the integrated amount of light is constant, the overall image density is not actually changed. Furthermore, it is noticeable that the range of the axis-c electric field intensity is narrower, compared to the method (the above-described exposure condition 1) of changing the duty and the method (the above-described exposure condition 2) of changing the modulated current. This means that the axis-c electric field intensity is increased and also the resolving power is maintained. As this method has fewer adverse effects, image degradation is less likely to occur. Furthermore, particular advantages can be expected such that development γ is stored and it is highly possible to deal with halftone images. That is, it is more effective to adjust the exposure condition by using a combination of the PM and the PWM.

According to the present embodiment, in the drive control device 107, a flag is attached to a black dot that is adjacent to a white dot, and an exposure condition is adjusted by using the flag.

As understood from the above explanation, in the optical scanning device 1010 according to the present embodiment, the electrostatic latent image forming method according to the present embodiment is performed by the scanning control device. Furthermore, in the laser printer 1000 according to the present embodiment, the electrostatic latent image forming apparatus according to the present embodiment is configured by the optical scanning device 1010.

As described above, the optical scanning device 1010 according to the present embodiment includes the light source 11, the prior-deflector optical system, the polygon mirror 15, the optical scanning system 20, the scanning control device, or the like.

The scanning control device includes the light-source control device 104, and the light-source control device 104 includes the reference-clock generation circuit 105, the pixel-clock generation circuit 106, the drive control device 107, the light-source drive circuit 108, or the like.

In the drive control device 107, if the number of black dots that are adjacent to the white dot is four, the flag A is attached to the adjacent black dots, if the number of black dots that are adjacent to the white dot is three, the flag B is attached to the adjacent black dots, if the number of black dots that are adjacent to the white dot is two, the flag C is attached to the adjacent black dots, and if the number of black dots that are adjacent to the white dot is one, the flag D is attached to the adjacent black dot.

Furthermore, in order to obtain EA≥EB≥EC≥ED, the drive control device 107 adjusts at least any one of the duty (lighting time), the modulated current, and the largest value of a light output in accordance with the flag. Thus, the axis-c electric field intensity of the electrostatic latent image that corresponds to the white dot can be increased so as to prevent toner adhesion. In this case, it is possible to form a higher-quality electrostatic latent image, compared to a conventional case.

In the present embodiment, it is determined that the cause of image degradation is generated at the step of obtaining a latent image before developing it, and it is solved at the step of obtaining the electrostatic latent image before transferring it to the next step; thus, it is possible to achieve a higher image quality and stabilization of a microscopic character image, especially, an inverted character image, which is conventionally insufficient. It is certain that, if the environment of the actual apparatus or a peripheral image pattern is different, a value in the latent-image electric field vector in the vertical direction of a specimen is changed; however, as the direction of image degradation and the direction of image improvement by mode settings on the basis of the BM number are the same, it is possible to improve the image quality by selecting the set value in accordance with the actual apparatus without performing a complicated operation, such as edge detection or object information.

Furthermore, in the present embodiment, without performing a special operation, such as edge detection or character information recognition, it is possible to set a method that is simple and can be applied to any images; therefore, even though the object information is not received when the image data is converted into a light-source modulation data, it is possible to deal with it. Furthermore, there is no need to deal with each character, and it is possible to deal with any characters or, in some cases, any images. Moreover, there is no need to recognize characters.

Furthermore, in the present embodiment, while the settings for a white dot area are maintained as default, the same effect is produced as that obtained when the amount of charge of the white dot area is actually increased; thus, it is possible to improve the image quality of the white dot area. By using this method, as the direction of image degradation and the direction of image improvement according to the settings are the same, it is possible to improve the image quality. The optimum set value may be appropriately set in accordance with the actual apparatus.

Moreover, as it is determined that the cause of image degradation is generated at the step of obtaining a latent image before developing it, it is solved at the step of obtaining the electrostatic latent image before transferring it to the next step; thus, it is possible to provide an electrostatic latent image forming apparatus that can achieve a higher image quality and stabilization of a microscopic character image, especially, an inverted character image, which is conventionally insufficient.

Furthermore, as a unit is provided to increase the latent-image electric field vector in the vertical direction of a specimen so as to prevent toner adhesion, it is possible to output a character image of a microscopic size, i.e., a white-on-black inverted character image, with a high image quality. Moreover, it is possible to provide an electrostatic latent image forming apparatus that can be used for any images and that uses a simple rule without performing a special operation, such as edge detection or character information recognition.

Furthermore, the average light output is decreased by using the PWM as appropriate in accordance with the circumstances of adjacent pixels; thus, it is possible to change the magnitude of the latent-image electric field vector in the vertical direction of a specimen, and it is possible to achieve a higher image quality of inverted images, or the like.

Moreover, as the maximum light output is purposefully increased by using the PM and PWM, the integrated amount of light can be the same, and the overall image density can be actually set unchanged. A more noticeable feature is that the range of the latent-image electric field vector is narrower compared to the other methods, and it means that the resolving power is maintained while the latent-image electric field vector is increased. That is, image degradation is less likely to occur, development γ is stored, and particular advantages can be expected such that it is possible to deal with halftone images.

Moreover, as evaluation is made by using electrostatic latent images, it is possible to send feedbacks to the design, and the process quality of each step is improved; thus, it is possible to provide a latent-image carrier and an optical scanning system that are superior in a high image quality and high stabilization, and it is possible to provide an image forming apparatus that achieves a high density and high image quality by performing development and visualization. Especially, it is suitable for an image forming apparatus that includes a multibeam optical scanning system, such as VCSEL.

Furthermore, as the laser printer 1000 includes the optical scanning device 1010, it is accordingly possible to form a high-quality image.

In the above-described embodiment, instead of the surface-emitting laser array, a semiconductor laser array (LD array) that has multiple light emitting units in a one-dimensional array may be used, or a semiconductor laser (LD) that includes a single light emitting unit may be used.

Furthermore, in the above-described embodiment, instead of the coupling lens 12, an optical coupling system that includes a plurality of lenses may be used.

Moreover, in the above-described embodiment, instead of the cylindrical lens 14, an optical linear-image forming system that includes a plurality of lenses may be used.

In the above-described embodiment, an explanation is given of a case where the image forming apparatus is the laser printer 1000; however, this is not a limitation.

Figure 45:
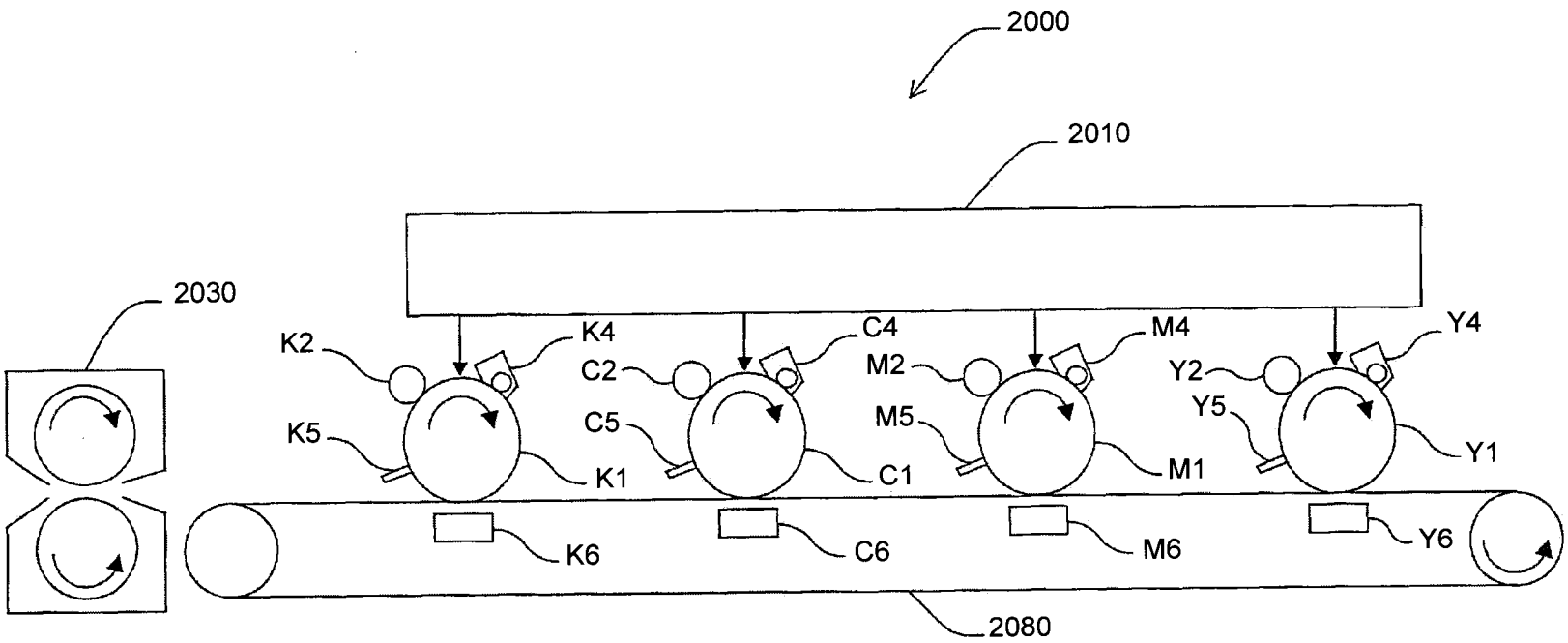
FIG. 45 is a diagram that illustrates a schematic configuration of a color printer.

As illustrated in FIG. 45, for example, the image forming apparatus may be a color printer 2000 that includes a plurality of photosensitive drums.

The color printer 2000 is a tandem-system multicolor printer that superimposes four colors (black, cyan, magenta, and yellow) so as to form a full-color image, and it includes "a photosensitive drum K1, a charge device K2, developing device K4, a cleaning unit K5, and a transfer device K6" for black; "a photosensitive drum C1, a charge device C2, a developing device C4, a cleaning unit C5, and a transfer device C6" for cyan; "a photosensitive drum M1, a charge device M2, a developing device M4, a cleaning unit M5, and a transfer device M6" for magenta; "a photosensitive drum Y1, a charge device Y2, a developing device Y4, a cleaning unit Y5, and a transfer device Y6" for yellow; an optical scanning device 2010; a transfer belt 2080; a fixing unit 2030, or the like.

Each of the charge devices uniformly charges a surface of the corresponding photosensitive drum. The optical scanning device 2010 optically scans the charged surface of each of the photosensitive drums so as to form an electrostatic latent image on each of the photosensitive drums. Each of the electrostatic latent images is developed by the corresponding developing device, whereby a toner image is formed. Each of the toner images is transferred onto a recording sheet on the transfer belt 2080 by the corresponding transfer device, and it is finally fixed thereto by the fixing unit 2030.

The optical scanning device 2010 includes the same drive control device as the drive control device 107 for each of the colors. Thus, the optical scanning device 2010 can produce the same advantage as that of the optical scanning device 1010. Furthermore, as the color printer 2000 includes the optical scanning device 2010, it can produce the same advantage as that of the laser printer 1000.

Furthermore, in the above-described embodiment, an explanation is given of a case where the optical scanning device 1010 is used in the printer; however, it may be used in image forming apparatuses other than the printer, such as a copier, facsimile machine, or multifunction peripheral that has a combination of the above.

According to the electrostatic latent image forming method in the present embodiment, it is possible to form a high-quality electrostatic latent image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electrostatic latent image forming method for forming, on an image carrier, an electrostatic latent image that has a pattern including an irradiated area and a not-irradiated area in a mixed manner, the electrostatic latent image forming method comprising:

adjusting an exposure condition of the irradiated area; and irradiating the image carrier with light under the adjusted exposure condition, wherein, in the pattern, the not-irradiated area includes a white dot and the irradiated area includes black dots, and wherein the adjusting includes adjusting an exposure condition of at least a first black dot that is adjacent to the white dot so that an exposure-amount for exposing the first black dot is larger than a predetermined exposure-amount for exposing a second black dot that is not adjacent to the white dot, and an exposure-time for exposing the first black dot is shorter than a predetermined exposure-time for exposing the second black dot.

2. The electrostatic latent image forming method according to claim 1, wherein the adjusting includes reducing a lighting time for at least the first black dot that is adjacent to the white dot relative to the second black dot that is not adjacent to the white dot.

3. The electrostatic latent image forming method according to claim 1, wherein the adjusting includes increasing a maximum value of light output and reducing a lighting time for at least the first black dot that is adjacent to the white dot relative to the second black dot that is not adjacent to the white dot.

4. The electrostatic latent image forming method according to claim 1, wherein the adjusting includes adjusting the exposure condition of the irradiated area that is included in the irradiated area and is adjacent to the not-irradiated area so that an electric field intensity of an electrostatic latent image that corresponds to the non-irradiated area is increased so as to prevent adhesion of a developer.

5. The electrostatic latent image forming method according to claim 4, wherein the adjusting includes adjusting the exposure condition such that the electric field intensity is increased for at least the first black dot that is adjacent to the white dot relative to the second black dot that is not adjacent to the white dot.

6. The electrostatic latent image forming method according to claim 1, wherein the adjusting includes adjusting the exposure condition for at least the first black dot that is adjacent to the white dot in accordance with a number of black dots that are adjacent to the white dot.

7. The electrostatic latent image forming method according to claim 1, wherein an integrated amount of light is kept constant as the light output is changed.

8. The electrostatic latent image forming method according to claim 2, wherein when reducing the lighting time, the adjusting includes performing lighting for at least the first black dot at a timing separate from that for the white dot.

9. The electrostatic latent image forming method according to claim 3, wherein when reducing the lighting time, the adjusting includes performing lighting for at least the first black dot at a timing separate from that for the white dot.

10. An electrostatic latent image forming apparatus that forms an electrostatic latent image on an image carrier, the electrostatic latent image forming apparatus comprising:

a light source;

an optical system to guide light emitted by the light source to the image carrier; and an adjustment device during formation of an electrostatic latent image that has a pattern including an irradiated area and a not-irradiated area in a mixed manner, to adjust an exposure condition of the irradiated area, wherein, in the pattern, the not-irradiated area includes a white dot and the irradiated area includes black dots, and wherein the adjustment device adjusts an exposure condition of at least a first black dot that is adjacent to the white dot so that an exposure-amount for exposing the first black dot is larger than a predetermined exposure-amount for exposing a second black dot that is not adjacent to the white dot, and an exposure-time for exposing the first black dot is shorter than a predetermined exposure-time for exposing the second black dot.

11. The electrostatic latent image forming apparatus according to claim 10, wherein the adjustment device reduces a lighting time for at least the first black dot that is adjacent to the white dot relative to the second black dot that is not adjacent to the white dot.

12. The electrostatic latent image forming apparatus according to claim 10, wherein the adjustment device increases a maximum value of light output and reduces a lighting time for at least the first black dot that is adjacent to the white dot relative to the second black dot that is not adjacent to the white dot.

13. The electrostatic latent image forming apparatus according to claim 10, wherein the adjustment device adjusts the exposure condition of the irradiated area that is included in the irradiated area and is adjacent to the not-irradiated area so that an electric field intensity of an electrostatic latent image that corresponds to the non-irradiated area is increased so as to prevent adhesion of a developer.

14. The electrostatic latent image forming apparatus according to claim 10, wherein the adjustment device adjusts the exposure condition such that an electric field intensity is increased for at least the first black dot that is adjacent to the white dot relative to the second black dot that is not adjacent to the white dot.

15. The electrostatic latent image forming apparatus according to claim 10, wherein the adjustment device adjusts the exposure condition for at least the first black dot that is adjacent to the white dot in accordance with a number of black dots that are adjacent to the white dot.

16. The electrostatic latent image forming apparatus according to claim 11, wherein when reducing the lighting time, the adjustment device performs lighting for at least the first black dot at a timing separate from that for the white dot.

17. The electrostatic latent image forming apparatus according to claim 12, wherein when reducing the lighting time, the adjustment device performs lighting for at least the first black dot at a timing separate from that for the white dot.

18. The electrostatic latent image forming apparatus according to claim 10, wherein the adjustment device reduces light output for at least the first black dot that is adjacent to the white dot relative to the second black dot that is not adjacent to the white dot.

19. The electrostatic latent image forming apparatus according to claim 10, wherein an integrated amount of light is kept constant as the light output is changed.

20. An image forming apparatus including an electrostatic latent image forming apparatus for forming an electrostatic latent image on the image carrier, wherein the electrostatic latent image forming apparatus comprising: a light source;

an optical system to guide light emitted by the light source to the image carrier; and an adjustment device during formation of an electrostatic latent image that has a pattern including an irradiated area and a not-irradiated area in a mixed manner, to adjust an exposure condition of the irradiated area, wherein, in the pattern, the not-irradiated area includes a white dot and the irradiated area includes black dots, and wherein the adjustment device adjusts an exposure condition of at least a first black dot that is adjacent to the white dot so that an exposure-amount for exposing the first black dot is larger than a predetermined exposure-amount for exposing a second black dot that is not adjacent to the white dot, and an exposure-time for exposing the first black dot is shorter than a predetermined exposure-time for exposing the second black dot.

* * * * *